US009037053B2

(12) United States Patent
Fujii

(10) Patent No.: US 9,037,053 B2
(45) Date of Patent: May 19, 2015

(54) IMAGE FORMING APPARATUS INCLUDING TRANSFER BELT

(71) Applicant: KYOCERA Document Solutions Inc., Osaka-shi, Osaka (JP)

(72) Inventor: Koji Fujii, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 39 days.

(21) Appl. No.: 14/064,002

(22) Filed: Oct. 25, 2013

(65) Prior Publication Data

US 2014/0119782 A1 May 1, 2014

(30) Foreign Application Priority Data

Oct. 30, 2012 (JP) ..... 2012-239088

(51) Int. Cl.
*G03G 15/01* (2006.01)
*G03G 15/16* (2006.01)

(52) U.S. Cl.
CPC ..... *G03G 15/0189* (2013.01); *G03G 15/1615* (2013.01); *G03G 2215/00143* (2013.01)

(58) Field of Classification Search
CPC ..... G03G 15/0189; G03G 15/1615; G03G 2215/00143
USPC ..... 399/299
See application file for complete search history.

(56) References Cited

U.S. PATENT DOCUMENTS 8,571,450 B2 * 10/2013 Ichihashi ..... 399/299
2011/0249992 A1 * 10/2011 Yoshida ..... 399/299
2013/0189002 A1 * 7/2013 Ichihashi et al.

FOREIGN PATENT DOCUMENTS

JP 2002189333 A * 7/2002
JP 2009282419 A 12/2009

* cited by examiner

*Primary Examiner* — Susan Lee
(74) *Attorney, Agent, or Firm* — Alleman Hall McCoy Russell & Tuttle LLP

(57) ABSTRACT

A post-processing apparatus according to one aspect of the present disclosure includes: transfer belt; roller position adjustment mechanism; position information acquiring portion; first opposing portion which causes transfer belt to contact first image carrier; second opposing portion capable of being positioned at either contact position that causes transfer belt to contact second image carrier or separation position that causes transfer belt to be separated from second image carrier; movement mechanism portion which moves second opposing portion to contact position or separation position; first control portion which controls roller position adjustment mechanism so that transfer belt will return to target position, based on position information acquired by position information acquiring portion; and second control portion which, in the case where transfer belt does not return into a correction range and is out of correction range, controls movement mechanism portion so as to change position of second opposing portion.

11 Claims, 15 Drawing Sheets

IMAGE FORMING APPARATUS INCLUDING TRANSFER BELT

INCORPORATION BY REFERENCE

This application is based upon and claims the benefit of priority from the corresponding Japanese Patent Application No. 2012-239088 filed on Oct. 30, 2012, the entire contents of which are incorporated herein by reference.

BACKGROUND

The present disclosure relates to an image forming apparatus capable of forming a monochrome image in a single color and a color image composed of a plurality of colors.

An image forming apparatus such as a color printer includes, for example, a plurality of photosensitive drums that allow toner images for respective colors of black, yellow, magenta, and cyan to be formed thereon, and an intermediate transfer belt onto which the toner images formed on the plurality of photosensitive drums are to be transferred. The toner images for respective colors formed on the photosensitive drums are primarily transferred onto the intermediate transfer belt, and then collectively secondarily transferred onto a paper sheet from the intermediate transfer belt. Thus, a color image is formed on a paper sheet.

The above-described intermediate transfer belt extends over a drive roller linked with a drive source such as a motor, and a plurality of driven rollers. The intermediate transfer belt is rotated (endlessly moved) along with rotation of the drive roller, whereby toner images are sequentially transferred at positions opposing to the respective photosensitive drums.

The intermediate transfer belt may meander to deviate in the width direction of a roller during rotation. If the intermediate transfer belt meanders during rotation, when toner images are primarily transferred onto the intermediate transfer belt from the respective photosensitive drums, the positions of the toner images are displaced from each other, and this may cause color shift.

Conventionally, an image forming apparatus is known which includes a meandering resolving mode in which the orientation of a driven roller is set to a meandering resolving position so that the meandering intermediate transfer belt will return to a target position (reference position or such a range), and an equilibrium retaining mode in which the orientation of the driven roller is set to an equilibrium position so that the intermediate transfer belt will be retained at the target position. The image forming apparatus can return the meandering intermediate transfer belt to a target position by executing the meandering resolving mode.

The intermediate transfer belt may abnormally meander due to assembly defect of a drive mechanism such as a drive roller, for example. In the case where the intermediate transfer belt abnormally meanders, it may be impossible to return the intermediate transfer belt to a target position even if the image forming apparatus is operated in the above meandering resolving mode. In this case, printing by the image forming apparatus is automatically stopped. Then, until the defect is repaired, the image forming apparatus cannot perform either color printing and monochrome printing.

SUMMARY

An image forming apparatus according to one aspect of the present disclosure includes a first image carrier, a plurality of second image carriers, a transfer belt of endless belt type, a drive roller, a driven roller, a first opposing portion, a plurality of second opposing portions, a movement mechanism portion, position information acquiring portion, a first control portion, and a second control portion. A toner image is to be formed on the first image carrier. Toner images are to be formed on the plurality of second image carriers. The toner images formed on the first image carrier and/or the second image carriers are to be transferred onto the transfer belt of endless belt type. The drive roller supports the transfer belt in a rotatable manner and is capable of rotating the transfer belt. The driven roller supports the transfer belt in a rotatable manner. The first opposing portion is provided opposing to the first image carrier via the transfer belt and causes the transfer belt to contact the first image carrier. The plurality of second opposing portions are provided opposing to the plurality of second image carriers via the transfer belt and are each capable of being positioned at either contact positions that cause the transfer belt to contact the plurality of second image carriers or separation positions that cause the transfer belt to be separated from the plurality of second image carriers. The movement mechanism portion moves the positions of the plurality of second opposing portions to the contact positions or the separation positions. The position information acquiring portion acquires position information with respect to a width direction about the transfer belt. The roller position adjustment mechanism adjusts the orientation of a rotary shaft of the driven roller. The first control portion determines correction information for returning the transfer belt to a predetermined target position, based on the position information about the transfer belt acquired by the position information acquiring portion, and controls the roller position adjustment mechanism based on the correction information. The second control portion, in the case where, during the control for the roller position adjustment mechanism based on the correction information by the first control portion, the transfer belt does not return into a correction range centered on the target position within a predetermined time and is out of the correction range, controls the movement mechanism portion so as to change the positions of the plurality of second opposing portions.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment in the case where an image forming apparatus according to the present disclosure is applied to a printer capable of four-full-color printing and monochrome printing will be described with respect to the drawings.

Figure 1:
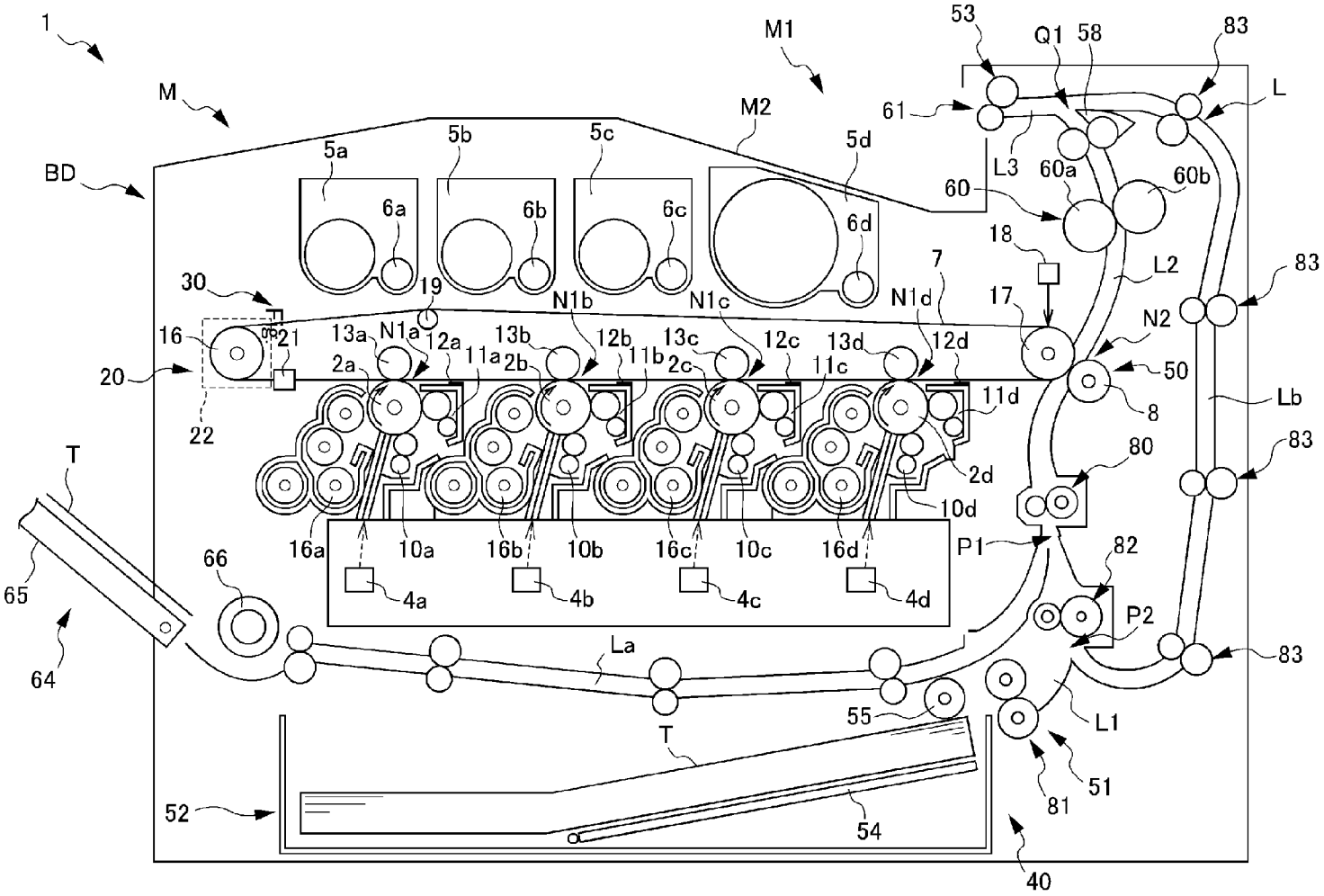
FIG. 1 is a diagram for explaining placements of constituent elements of a printer according to an embodiment.
Figure 2:
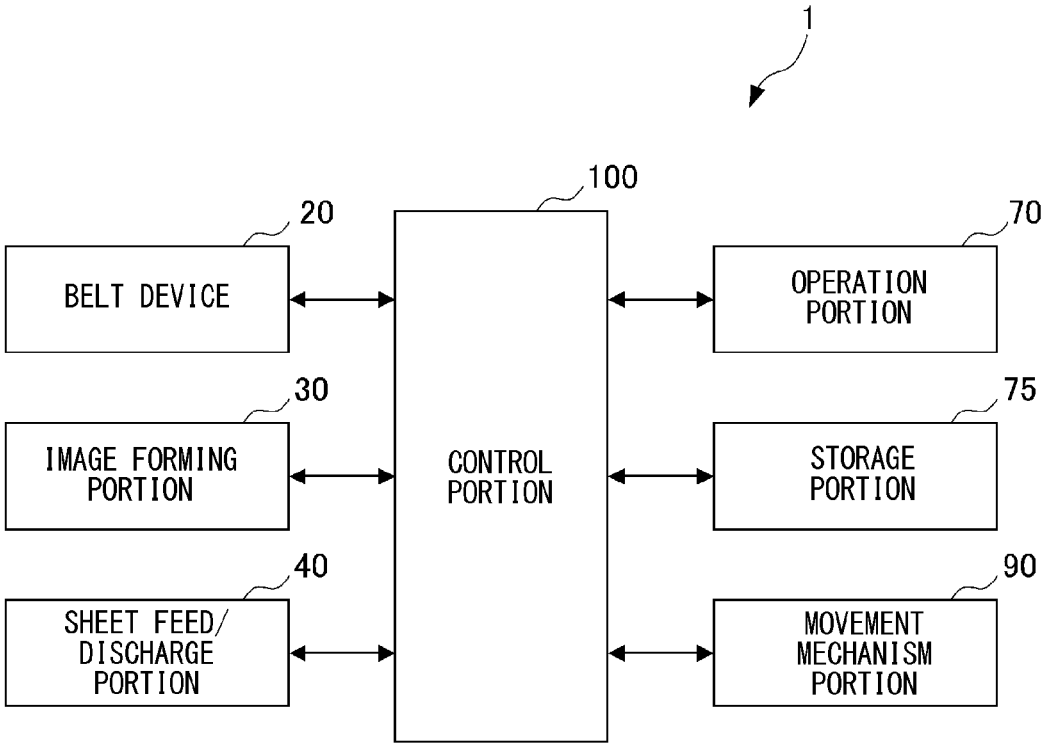
FIG. 2 is a block diagram showing the functional configuration of the printer.
Figure 3:
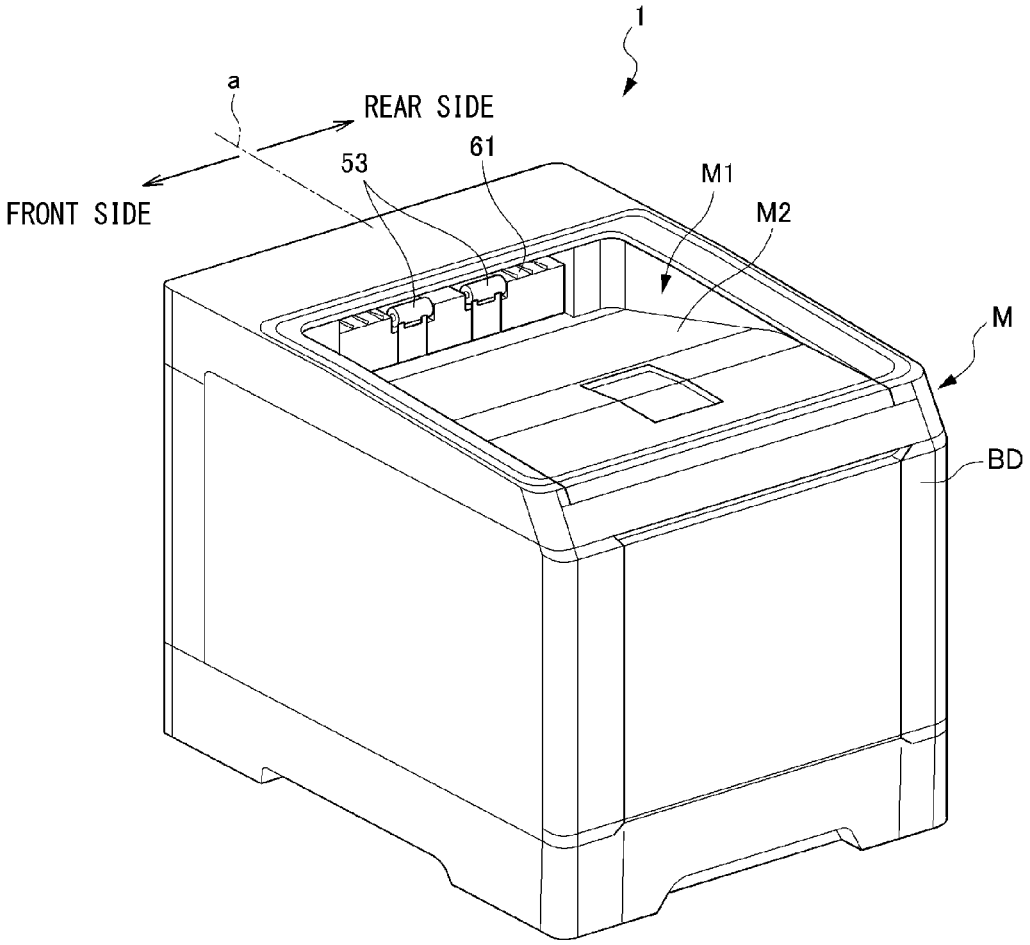
FIG. 3 is a perspective view showing the external appearance of the printer.

With reference to FIGS. 1 and 2, the entire structure of a printer 1 according to the present embodiment will be described. FIG. 1 is a diagram for explaining placements of constituent elements of the printer 1 according to the present embodiment. FIG. 2 is a block diagram showing the functional configuration of the printer 1. FIG. 3 is a perspective view showing the external appearance of the printer 1.

As shown in FIG. 1, the printer 1 according to the present embodiment includes an apparatus main body M, a belt device 20, an image forming portion 30, and a sheet feed/discharge portion 40. Besides these constituent elements, as shown in FIG. 2, the printer 1 includes an operation portion 70, a storage portion 75, a movement mechanism portion 90, and a control portion 100.

As shown in FIG. 1, the outer shape of the apparatus main body M of the printer 1 is formed by a case body BD as a housing.

As shown in FIG. 1, the image forming portion 30 is a portion that forms a toner image on a paper sheet T as a sheet-like transfer subject material based on predetermined image information. The image forming portion 30 includes photosensitive drums 2*a*, 2*b*, 2*c*, and 2*d*, charging portions 10*a*, 10*b*, 10*c*, and 10*d*, laser scanner units 4*a*, 4*b*, 4*c*, and 4*d*, developing devices 16*a*, 16*b*, 16*c*, and 16*d*, toner cartridges 5*a*, 5*b*, 5*c*, and 5*d*, toner feed portions 6*a*, 6*b*, 6*c*, and 6*d*, drum cleaning portions 11*a*, 11*b*, 11*c*, and 11*d*, electricity removing devices 12*a*, 12*b*, 12*c*, and 12*d*, primary transfer rollers 13*a*, 13*b*, 13*c*, and 13*d*, a transfer portion 50, and a fixing portion 60. It is noted that the image forming portion 30 includes a driven roller 16 and a drive roller 17 as a mechanism, and these rollers will be described in the description of the belt device 20 (described later).

In addition, as shown in FIG. 1, the sheet feed/discharge portion 40 is a portion that feeds a paper sheet T to the image forming portion 30 and discharges a paper sheet T having a toner image formed thereon. The sheet feed/discharge portion 40 includes a sheet feed cassette 52, a manual sheet feed portion 64, a conveyance path L for a paper sheet T, a registration roller pair 80, a plurality of rollers or roller pairs (with no reference characters), and a sheet discharge portion 61. It is noted that the conveyance path L is composed of a first conveyance path L1, a second conveyance path L2, a third conveyance path L3, a manual conveyance path La, and a return conveyance path Lb as described later.

Next, each component will be described in the order, the image forming portion 30, the sheet feed/discharge portion 40, and then the belt device 20.

First, the image forming portion 30 will be described. In the image forming portion 30, electric charging by the charging portions 10*a*, 10*b*, 10*c*, and 10*d*, light exposure by the laser scanner units 4*a*, 4*b*, 4*c*, and 4*d*, development by the developing devices 16*a*, 16*b*, 16*c*, and 16*d*, primary transfer by an intermediate transfer belt 7 (hereinafter, may be referred to as a "belt" with no reference character) and the primary transfer rollers 13*a*, 13*b*, 13*c*, and 13*d*, electricity removal by the electricity removing devices 12*a*, 12*b*, 12*c*, and 12*d*, and cleaning by the drum cleaning portions 11*a*, 11*b*, 11*c*, and 11*d*, are performed sequentially from upstream to downstream (left to right in FIG. 1) along the surfaces of the respective photosensitive drums 2*a*, 2*b*, 2*c*, and 2*d*.

In addition, in the image forming portion 30, secondary transfer by the intermediate transfer belt 7, a secondary transfer roller 8, and the drive roller 17, and fixing by the fixing portion 60, are performed.

The photosensitive drums 2*a*, 2*b*, 2*c*, and 2*d* are image carriers formed by cylindrical members. In the present embodiment, the photosensitive drum 2*a* is a second image carrier on which a toner image for yellow (Y) is to be formed, the photosensitive drum 2*b* is a second image carrier on which a toner image for cyan (C) is to be formed, the photosensitive drum 2*c* is a second image carrier on which a toner image for magenta (M) is to be formed, and the photosensitive drum 2*d* is a first image carrier on which a toner image for black (B) is to be formed.

Upon formation of a color image, toner images for the respective colors are formed on the photosensitive drums 2*a*, 2*b*, 2*c*, and 2*d*. On the other hand, upon formation of a monochrome image, a toner image for black is formed on the photosensitive drum 2*d* while toner images are not formed on the other photosensitive drums 2*a*, 2*b*, and 2*c*.

The photosensitive drums 2*a*, 2*b*, 2*c*, and 2*d* are provided so as to be rotatable in directions indicated by arrows around an axis extending in a direction perpendicular to the movement direction of the intermediate transfer belt 7. Electrostatic latent images are to be formed on the surfaces of the photosensitive drums 2*a*, 2*b*, 2*c*, and 2*d*.

The charging portions 10*a*, 10*b*, 10*c*, and 10*d* are provided facing to the surfaces of the respective photosensitive drums 2*a*, 2*b*, 2*c*, and 2*d*. The charging portions 10*a*, 10*b*, 10*c*, and 10*d* each uniformly charge the surfaces of the respective photosensitive drums 2*a*, 2*b*, 2*c*, and 2*d* into negative (minus polarity) or positive (plus polarity).

The laser scanner units 4*a*, 4*b*, 4*c*, and 4*d* function as light exposure units. The laser scanner units 4*a*, 4*b*, 4*c*, and 4*d* are provided being spaced from the surfaces of the respective photosensitive drums 2*a*, 2*b*, 2*c*, and 2*d*. The laser scanner units 4*a*, 4*b*, 4*c*, and 4*d* each include a laser light source, a polygon mirror, a motor for driving the polygon mirror, and the like (with no reference characters) not shown.

The laser scanner units 4*a*, 4*b*, 4*c*, and 4*d* scan and expose, to light, the surfaces of the respective photosensitive drums 2*a*, 2*b*, 2*c*, and 2*d* based on image information inputted from an external apparatus such as a PC (personal computer). Electric charges on portions of the surfaces of the respective photosensitive drums 2*a*, 2*b*, 2*c*, and 2*d* that have been scanned and exposed to light are removed. Thus, electrostatic latent images are formed on the surfaces of the respective photosensitive drums 2*a*, 2*b*, 2*c*, and 2*d*.

The developing devices 16*a*, 16*b*, 16*c*, and 16*d* are provided being associated with the respective photosensitive drums 2*a*, 2*b*, 2*c*, and 2*d* and facing to the surfaces of the respective photosensitive drums 2*a*, 2*b*, 2*c*, and 2*d*. The developing devices 16*a*, 16*b*, 16*c*, and 16*d* apply toners for respective colors to electrostatic latent images formed on the surfaces of the respective photosensitive drums 2*a*, 2*b*, 2*c*, and 2*d*, whereby toner images for respective colors are formed on the surfaces of the respective photosensitive drums 2*a*, 2*b*, 2*c*, and 2*d*. The developing devices 16*a*, 16*b*, 16*c*, and 16*d* respectively correspond to four colors of yellow, cyan, magenta, and black. The developing devices 16*a*, 16*b*, 16*c*, and 16*d* include development rollers facing to the surfaces of the respective photosensitive drums 2*a*, 2*b*, 2*c*, and 2*d*, stirring rollers for stirring toners, and the like (with no reference characters).

The toner cartridges 5*a*, 5*b*, 5*c*, and 5*d* are provided being associated with the respective developing devices 16*a*, 16*b*, 16*c*, and 16*d*, and contain toners for respective colors to be fed to the respective developing devices 16*a*, 16*b*, 16*c*, and 16*d*. The toner cartridges 5*a*, 5*b*, 5*c*, and 5*d* contain a toner for yellow, a toner for cyan, a toner for magenta, and a toner for black, respectively.

The toner feed portions 6*a*, 6*b*, 6*c*, and 6*d* are provided being associated with the respective toner cartridges 5*a*, 5*b*, 5*c*, and 5*d* and the respective developing devices 16*a*, 16*b*, 16*c*, and 16*d*. The toner feed portions 6*a*, 6*b*, 6*c*, and 6*d* feed toners for respective colors contained in the respective toner cartridges 5*a*, 5*b*, 5*c*, and 5*d* to the respective developing devices 16*a*, 16*b*, 16*c*, and 16*d*. The toner feed portions 6*a*, 6*b*, 6*c*, and 6*d* are connected to the respective developing devices 16*a*, 16*b*, 16*c*, and 16*d* via toner feed paths not shown.

On a side of the intermediate transfer belt 7 opposite to the photosensitive drums 2*a*, 2*b*, 2*c*, and 2*d*, the primary transfer rollers 13*a*, 13*b*, 13*c*, and 13*d* are provided opposing thereto, respectively. A predetermined portion of the intermediate transfer belt 7 is sandwiched between the respective primary transfer rollers 13*a*, 13*b*, 13*c*, and 13*d* and the respective photosensitive drums 2*a*, 2*b*, 2*c*, and 2*d*. The sandwiched predetermined portion is pressed to the surfaces of the respective photosensitive drums 2*a*, 2*b*, 2*c*, and 2*d*.

Primary transfer nips N1*a*, N1*b*, N1*c*, and N1*d* are formed between the photosensitive drums 2*a*, 2*b*, 2*c*, and 2*d* and the primary transfer rollers 13*a*, 13*b*, 13*c*, and 13*d*, respectively. At the primary transfer nips N1*a*, N1*b*, N1*c*, and N1*d*, toner images for respective colors developed on the photosensitive drums 2*a*, 2*b*, 2*c*, and 2*d* are sequentially primarily transferred onto the intermediate transfer belt 7. Thus, a four-full-color toner image is formed on the intermediate transfer belt 7.

It is noted that as described later, the primary transfer rollers 13*a*, 13*b*, and 13*c*, the driven roller 16, and a tension roller 19 are provided so as to be movable in the up-down direction in FIG. 1 by the movement mechanism portion 90 (see FIG. 8) which is not shown in FIG. 1.

In the printer 1, upon formation of a four-full-color toner image, the primary transfer rollers 13*a*, 13*b*, and 13*c*, the driven roller 16, and the tension roller 19 are moved downward in FIG. 1 by the movement mechanism portion 90. Thus, as described above, the primary transfer nips N1*a*, N1*b*, N1*c*, and N1*d* are formed between the photosensitive drums 2*a*, 2*b*, 2*c*, and 2*d* and the primary transfer rollers 13*a*, 13*b*, 13*c*, and 13*d*, respectively.

In addition, in the printer 1, upon formation of a monochrome toner image, the primary transfer rollers 13*a*, 13*b*, and 13*c*, the driven roller 16, and the tension roller 19 are moved upward in FIG. 1 by the movement mechanism portion 90. Thus, only the primary transfer nip N1*d* is formed between the photosensitive drum 2*d* and the primary transfer roller 13*d*.

In FIG. 1, the primary transfer rollers 13*a*, 13*b*, and 13*c* are provided opposing to the plurality of photosensitive drums (second image carriers) 2*a*, 2*b*, and 2*c* via the intermediate transfer belt (belt) 7, and form a plurality of second opposing portions that can be moved to either contact positions (described later) that cause the intermediate transfer belt 7 to contact the plurality of photosensitive drums 2*a*, 2*b*, and 2*c* or separation positions (described later) that cause the intermediate transfer belt 7 to be separated from the plurality of photosensitive drums 2*a*, 2*b*, and 2*c*.

In addition, in FIG. 1, the primary transfer roller 13*d* is provided opposing to the photosensitive drum (first image carrier) 2*d* via the intermediate transfer belt 7, and forms a first opposing portion that causes the intermediate transfer belt 7 to contact the photosensitive drum 2*d*. It is noted that the configuration of the movement mechanism portion 90 will be described later.

A primary transfer bias applying portion (not shown) applies, to the primary transfer rollers 13*a*, 13*b*, 13*c*, and 13*d*, primary transfer biases for transferring toner images for respective colors formed on the respective photosensitive drums 2*a*, 2*b*, 2*c*, and 2*d* onto the intermediate transfer belt 7.

The electricity removing devices 12*a*, 12*b*, 12*c*, and 12*d* are provided facing to the surfaces of the respective photosensitive drums 2*a*, 2*b*, 2*c*, and 2*d*. The electricity removing devices 12*a*, 12*b*, 12*c*, and 12*d* radiate light onto the surfaces of the respective photosensitive drums 2*a*, 2*b*, 2*c*, and 2*d*, thereby removing electricity (removing electric charge) on the surfaces of the respective photosensitive drums 2*a*, 2*b*, 2*c*, and 2*d* after primary transfer.

The drum cleaning portions 11*a*, 11*b*, 11*c*, and 11*d* are provided facing to the surfaces of the respective photosensitive drums 2*a*, 2*b*, 2*c*, and 2*d*. The drum cleaning portions 11*a*, 11*b*, 11*c*, and 11*d* remove residual toners or adhered substances on the surfaces of the respective photosensitive drums 2*a*, 2*b*, 2*c*, and 2*d*, and convey the removed toner and the like to a predetermined recovery mechanism, thus recovering them.

The transfer portion 50 transfers a toner image transferred onto the surface of the intermediate transfer belt 7, onto a paper sheet T. The transfer portion 50 includes the secondary transfer roller 8 and the drive roller 17.

The secondary transfer roller 8 is a roller for secondarily transferring a four-full-color toner image primarily transferred onto the intermediate transfer belt 7, onto a paper sheet T. A secondary transfer bias applying portion (not shown) applies, to the secondary transfer roller 8, a secondary transfer bias for transferring a four-full-color toner image formed on the intermediate transfer belt 7 onto a paper sheet T.

The secondary transfer roller 8 is caused to contact or be separated from the intermediate transfer belt 7. Specifically, the secondary transfer roller 8 is configured to be movable to a contact position that causes the secondary transfer roller 8 to contact the intermediate transfer belt 7 or a separation position that causes the secondary transfer roller 8 to be separated from the intermediate transfer belt 7. In detail, the secondary transfer roller 8 is placed at the contact position when a four-full-color toner image or a monochrome toner image primarily transferred onto the surface of the intermediate transfer belt 7 is to be secondarily transferred onto a paper sheet T, and placed at the separation position in the other cases.

The drive roller 17 is provided on a side of the intermediate transfer belt 7 opposite to the secondary transfer roller 8.

A predetermined portion of the intermediate transfer belt 7 is sandwiched between the secondary transfer roller 8 and the drive roller 17. A secondary transfer nip N2 is formed between the intermediate transfer belt 7 and the secondary transfer roller 8. At the secondary transfer nip N2, a paper sheet T is pressed to the outer surface (surface onto which a toner image has been transferred) of the intermediate transfer belt 7. At the secondary transfer nip N2, a four-full-color toner image primarily transferred onto the intermediate transfer belt 7 is secondarily transferred onto a paper sheet T.

The fixing portion 60 melts and pressurizes toners for respective colors forming a toner image secondarily transferred onto a paper sheet T, thereby fixing the toners on the paper sheet T. The fixing portion 60 includes a heating rotary body 60*a* to be heated by a heater (not shown), and a pressurizing rotary body 60*b* to be pressed to the heating rotary body 60*a*. The heating rotary body 60*a* and the pressurizing rotary body 60*b* sandwich a paper sheet T having a toner image secondarily transferred thereon, to pressurize the paper sheet T, while conveying the paper sheet T downstream. When the paper sheet T is conveyed being sandwiched between the heating rotary body 60*a* and the pressurizing rotary body 60*b*, the toner transferred thereon is melted and pressurized. Thus, the toner transferred onto the paper sheet T is fixed on the surface of the paper sheet T.

Next, the sheet feed/discharge portion 40 will be described. As shown in FIG. 1, the sheet feed cassette 52 for containing a paper sheet T is provided at a lower portion of the apparatus main body M. The sheet feed cassette 52 is configured to be drawable in the horizontal direction from the housing of the apparatus main body M. A stacking plate 54 that allows a paper sheet T to be stacked thereon is provided in the sheet feed cassette 52. Paper sheets T, being stacked on the stacking plate 54, are contained in the sheet feed cassette 52. A paper sheet T placed on the stacking plate 54 is fed to the first conveyance path L1 from a cassette sheet feed portion 51 provided at an end portion of the sheet feed cassette 52 on a sheet feed side (end portion at the right in FIG. 1). The cassette sheet feed portion 51 includes a multi-feed preventing mechanism composed of a forward feed roller 55 for taking out a paper sheet T on the stacking plate 54, and a sheet feed roller pair 81 for feeding a paper sheet T one by one to the conveyance path L.

The manual sheet feed portion 64 for containing a paper sheet T is provided on a left side surface (at the left in FIG. 1) of the apparatus main body M. The manual sheet feed portion 64 is provided mainly for the purpose of feeding, to the apparatus main body M, a paper sheet T having a size or a kind different from that of a paper sheet T set in the sheet feed cassette 52. The manual sheet feed portion 64 includes a manual tray 65 which forms a part of the left side surface of the apparatus main body M in a closed state, and a sheet feed roller 66. A lower end of the manual tray 65 is attached in a rotatable (openable/closable) manner on the vicinity of the sheet feed roller 66. The manual tray 65 in an opened state allows a paper sheet T to be stacked thereon. The sheet feed roller 66 feeds a paper sheet T placed on the manual tray 65 in an opened state, to the manual conveyance path La.

The conveyance path L for conveying a paper sheet T includes the first conveyance path L1 from the cassette sheet feed portion 51 to the secondary transfer nip N2, the second conveyance path L2 from the secondary transfer nip N2 to the fixing portion 60, the third conveyance path L3 from the fixing portion 60 to the sheet discharge portion 61, the manual conveyance path La which passes a paper sheet fed from the manual sheet feed portion 64 to merge into the first conveyance path L1, and the return conveyance path Lb which returns a paper sheet conveyed from downstream to upstream on the third conveyance path L3 to the first conveyance path L1 while inverting the paper sheet.

The first conveyance path L1 conveys a paper sheet T contained in the sheet feed cassette 52 to the image forming portion 30. The manual conveyance path La conveys a paper sheet T contained in the manual sheet feed portion 64 to the registration roller pair 80 described later.

In addition, a first merging portion P1 and a second merging portion P2 are provided on the first conveyance path L1, and a first branching portion Q1 is provided on the third conveyance path L3.

The first merging portion P1 is a merging portion where the manual conveyance path La merges into the first conveyance path L1. The second merging portion P2 is a merging portion where the return conveyance path Lb merges into the first conveyance path L1. The first branching portion Q1 is a branching portion where the return conveyance path Lb branches from the third conveyance path L3.

On the first conveyance path L1 (in detail, between the second merging portion P2 and the secondary transfer roller 8), a sheet detection sensor (not shown) for detecting a paper sheet T, and a registration roller pair 80 for correcting skew (oblique sheet feed) of a paper sheet T or adjusting a timing in accordance with formation of a toner image by the image forming portion 30, are provided. The sheet detection sensor is provided immediately before (on the upstream side in the conveyance direction) the registration roller pair 80 in the conveyance direction of a paper sheet T. The registration roller pair 80 performs the above correction or timing adjustment based on detected signal information from the sheet detection sensor, to convey a paper sheet T.

A first conveying roller pair 82 is provided between the first merging portion P1 and the second merging portion P2 on the first conveyance path L1. The first conveying roller pair 82 is provided on the downstream side of the sheet feed roller pair 81, and holds and conveys a paper sheet T conveyed by the sheet feed roller pair 81, to the registration roller pair 80.

The return conveyance path Lb is a conveyance path provided for, upon both-side printing on a paper sheet T, causing a side (not printed yet) of the paper sheet T opposite to a side on which printing has been already performed, to face to the intermediate transfer belt 7. A plurality of second conveying roller pairs 83 for conveying a paper sheet T to the second merging portion P2 are provided at predetermined intervals on the return conveyance path Lb. The return conveyance path Lb can invert a paper sheet T conveyed from the first branching portion Q1 to the sheet discharge portion 61 side, and return the paper sheet T to the first conveyance path L1, thus conveying the paper sheet T to the upstream side of the registration roller pair 80 provided on the upstream side of the secondary transfer roller 8. At the secondary transfer nip N2, a predetermined toner image is transferred onto a side on which printing has not been performed yet, of the paper sheet T inverted by the return conveyance path Lb.

A rectification member 58 is provided on the first branching portion Q1. The rectification member 58 rectifies the conveyance direction of a paper sheet T conveyed from the fixing portion 60 through the third conveyance path L3 from upstream to downstream, so as to be directed toward the sheet discharge portion 61, and rectifies the conveyance direction of a paper sheet T conveyed from the sheet discharge portion 61 through the third conveyance path L3 from downstream to upstream, so as to be directed toward the return conveyance path Lb.

The sheet discharge portion 61 is formed at the end of the third conveyance path L3. The sheet discharge portion 61 is provided on the upper side of the apparatus main body M. The sheet discharge portion 61 opens toward the left side surface (leftward in FIG. 1) of the apparatus main body M. The sheet discharge portion 61 discharges a paper sheet T to the outside of the apparatus main body M. The sheet discharge portion 61 includes a discharge roller pair 53. The discharge roller pair 53 can discharge a paper sheet T conveyed on the third conveyance path L3 from upstream to downstream, to the outside of the apparatus main body M, or convey a paper sheet T to the upstream side of the third conveyance path L3 after inverting the conveyance direction of the paper sheet T at the sheet discharge portion 61.

A discharged sheet accumulation portion M1 is formed on the opening side of the sheet discharge portion 61. The discharged sheet accumulation portion M1 is formed on the upper surface (outer surface) of the apparatus main body M. The discharged sheet accumulation portion M1 is a portion of the upper surface of the apparatus main body M, that is recessed downward. The bottom surface of the discharged sheet accumulation portion M1 is formed by a top cover member M2 which forms a part of the upper surface of the apparatus main body M. Paper sheets T discharged from the sheet discharge portion 61 after predetermined toner images have been formed thereon are stacked and accumulated on the upper surface of the top cover member M2 forming the discharged sheet accumulation portion M1. It is noted that sensors (not shown) for sheet detection are provided at predetermined positions on the conveyance paths.

Next, the belt device 20 will be described. The belt device 20 is a device capable of rotating the intermediate transfer belt 7 and correcting meandering of the belt. The belt device 20 includes the intermediate transfer belt 7, the driven roller 16, the drive roller 17, the first drive motor 18, the tension roller 19, a belt sensor 21 as position information acquiring portion, a roller position adjustment mechanism 22, and a support roller 23 (see FIG. 8).

The intermediate transfer belt 7 is an endless belt extending over a plurality of rollers including the driven roller 16, the drive roller 17, the tension roller 19, and the like. Toner images for respective colors are primarily transferred onto the intermediate transfer belt 7 from the primary transfer rollers 13*a*, 13*b*, 13*c*, and 13*d*. In addition, the toner images for respective colors primarily transferred onto the intermediate transfer belt 7 are secondarily transferred onto a paper sheet T at the position of the secondary transfer roller 8.

The driven roller 16 is a roller supporting the intermediate transfer belt 7 in a rotatable manner. The driven roller 16 is supported by the roller position adjustment mechanism 22 (described later).

The drive roller 17 is a roller that supports the intermediate transfer belt 7 in a rotatable manner and rotates the intermediate transfer belt 7. The drive roller 17 rotates in a predetermined direction by a rotational force given by the first drive motor 18.

The first drive motor 18 is a device that gives a rotational force to the drive roller 17. The first drive motor 18 is electrically connected to the control portion 100 (described later). The rotation speed of the first drive motor 18 is controlled by a drive signal outputted from the control portion 100.

The tension roller 19 is a roller that energizes the intermediate transfer belt 7 from inside to outside. The energizing force by the tension roller 19 gives a predetermined tension to the intermediate transfer belt 7.

The driven roller 16 and the drive roller 17 are set such that their respective rotary shafts (with no references) are parallel to each other, and provided at positions opposite to each other in the longitudinal direction of the intermediate transfer belt 7. The intermediate transfer belt 7 rotates around a plurality of rollers including the driven roller 16, the drive roller 17, the tension roller 19, and the like along with rotation of the drive roller 17.

Figure 4:
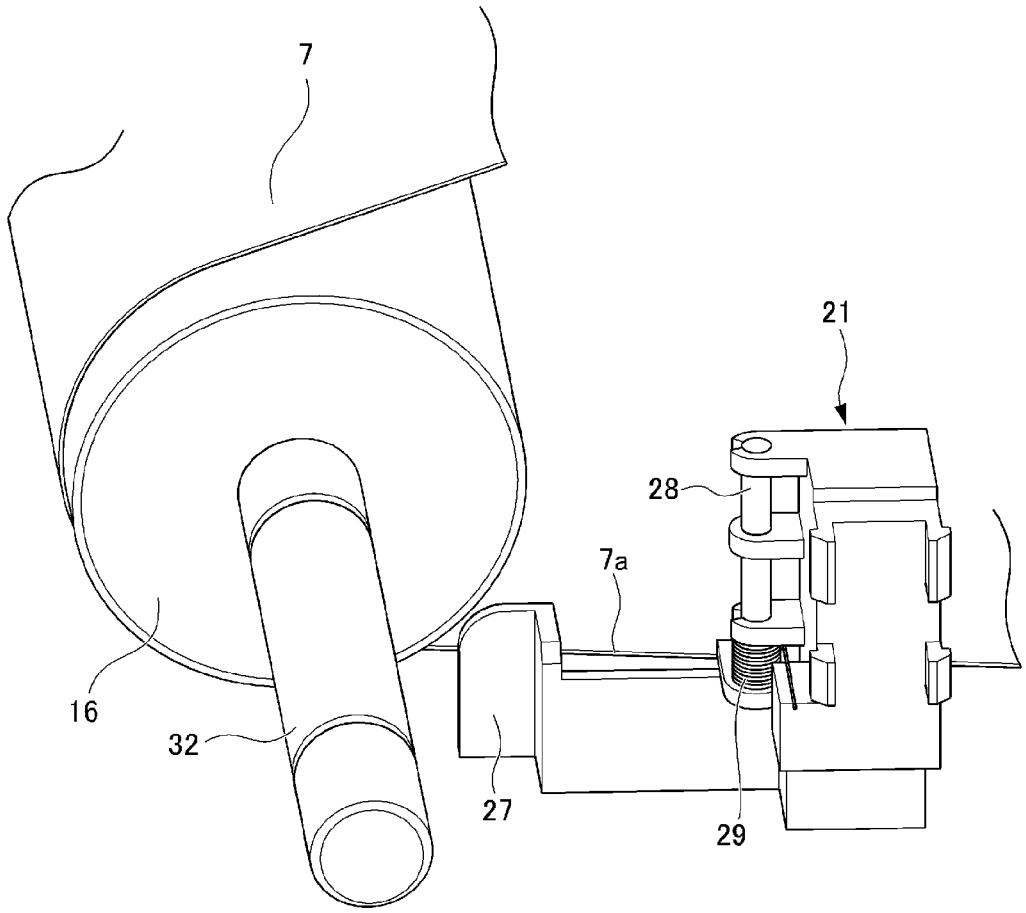
FIG. 4 is a perspective view showing a belt sensor and a driven roller of a belt device.
Figure 5:
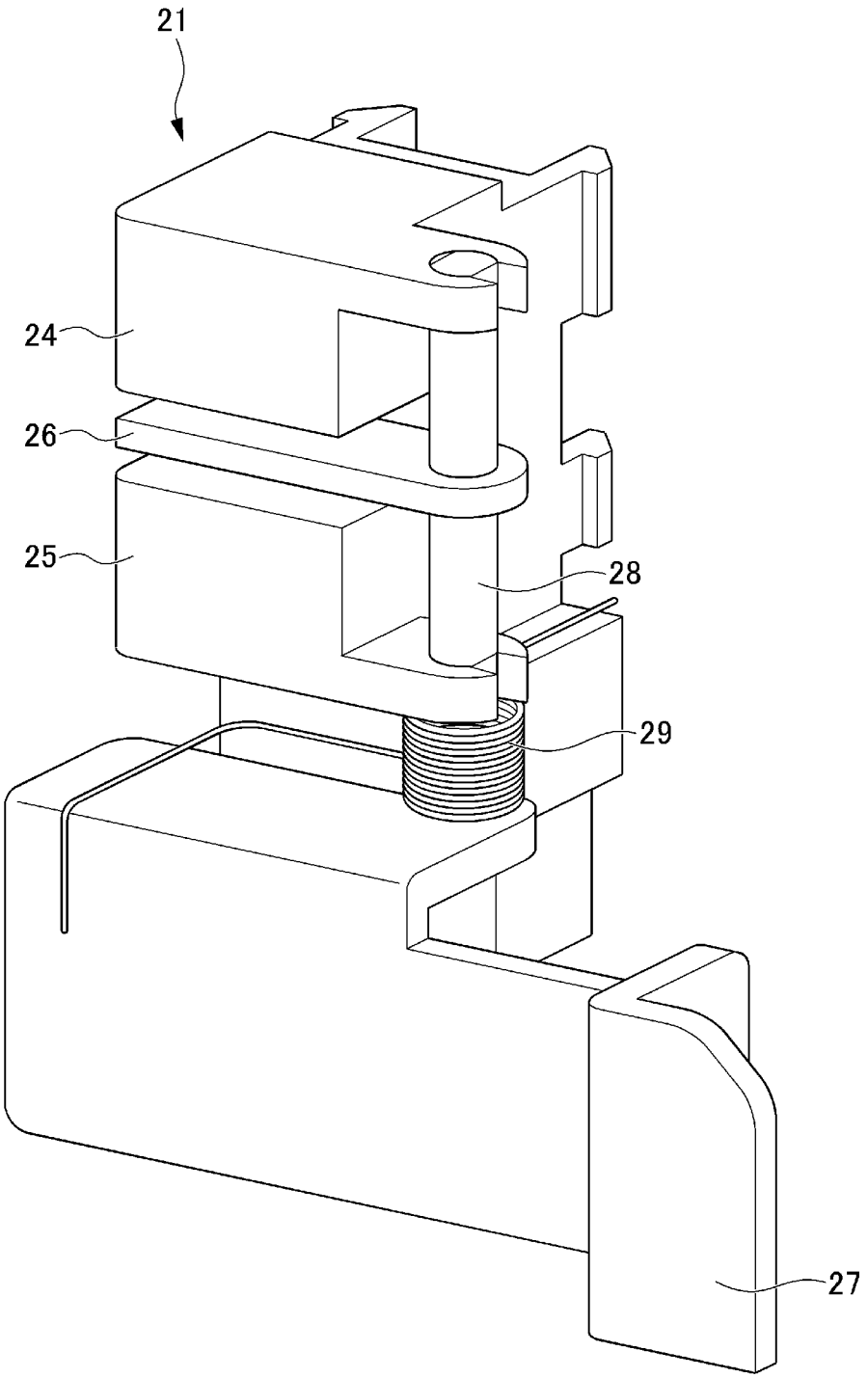
FIG. 5 is a perspective view showing the configuration of the belt sensor of the belt device.
Figure 6:
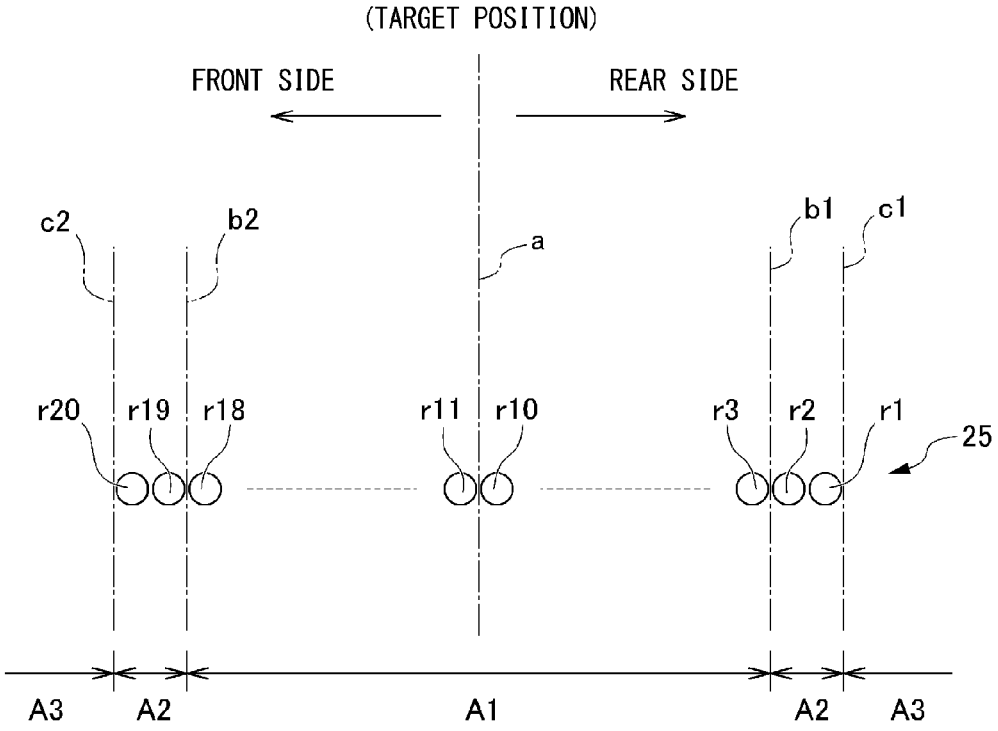
FIG. 6 is a schematic diagram showing a light reception range of a light reception portion.
Figure 7:
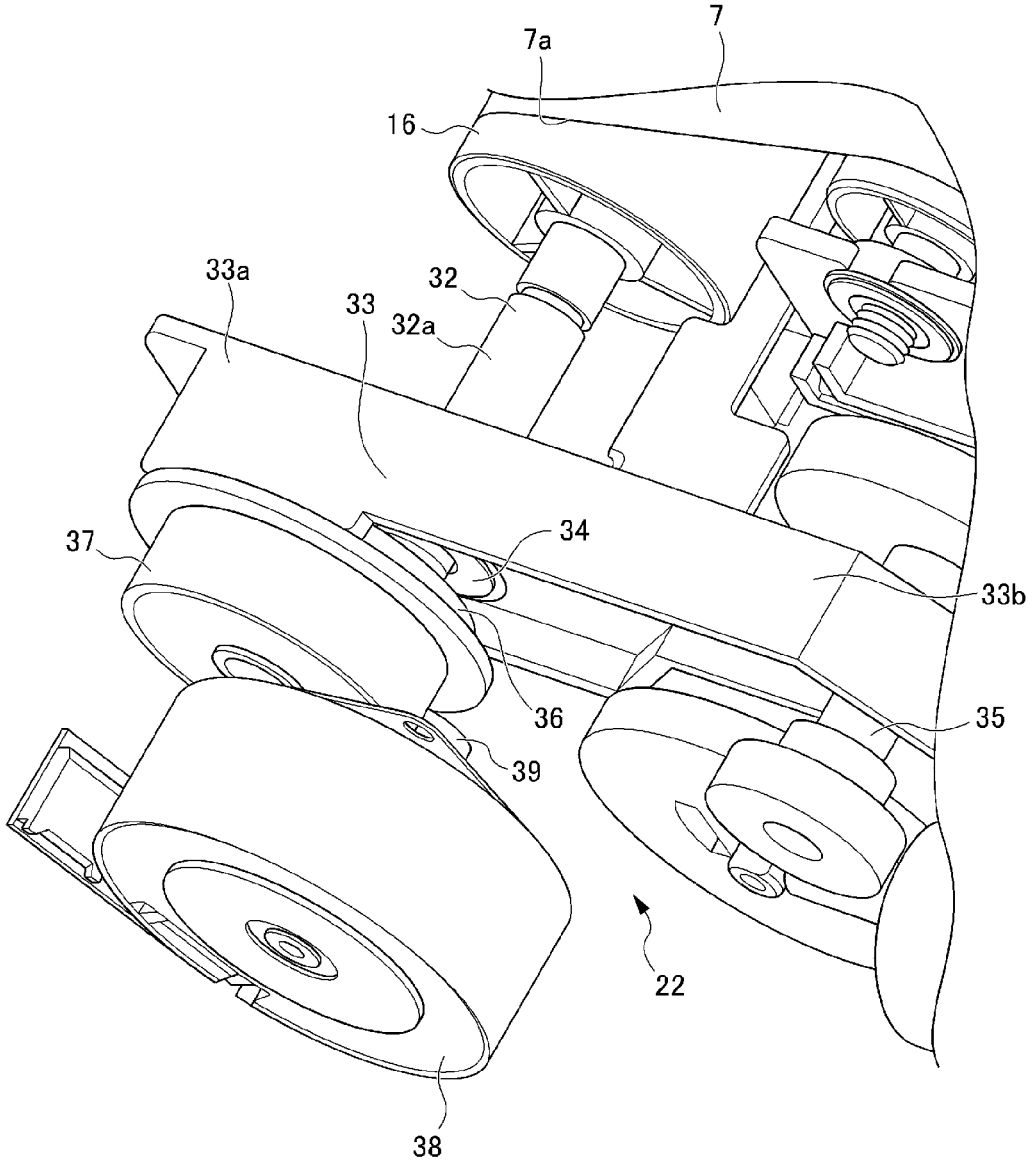
FIG. 7 is a perspective view showing the driven roller of the belt device and the peripheral part.

Next, a peripheral part including the belt sensor 21 and the roller position adjustment mechanism 22 will be described. FIG. 4 is a perspective view showing the belt sensor and the driven roller 16 of the belt device 20. FIG. 5 is a perspective view showing the configuration of the belt sensor of the belt device 20. FIG. 6 is a schematic diagram showing a light reception range of a light reception portion 25. FIG. 7 is a perspective view showing the driven roller 16 of the belt device 20 and a peripheral part thereto.

As shown in FIG. 4 (or FIG. 1), the belt sensor 21 is provided in the vicinity of the driven roller 16 on the circulation track of the intermediate transfer belt 7. As shown in FIG. 5, the belt sensor 21 includes a light emitting portion 24, the light reception portion 25, and a light shielding plate 26. The light emitting portion 24 radiates light in a predetermined direction (downward in FIGS. 4 and 5). Light receiving elements r1 to r20 (described later) of the light reception portion 25 receive light radiated by the light emitting portion 24, and respectively output voltage values corresponding to the light reception amounts as light amount detection signals (position information) to the control portion 100. The light reception portion 25 is provided at a position opposite to the light emitting portion 24. The light shielding plate 26 is a member provided so as to be movable between the light emitting portion 24 and the light reception portion 25.

In addition, as shown in FIGS. 4 and 5, the belt sensor 21 includes a contact plate 27 and a joint bar 28. As shown in FIG. 4, the contact plate 27 is a member contacting a belt end surface 7*a* of the intermediate transfer belt 7. The joint bar 28 is a member jointing the contact plate 27 and the light shielding plate 26. The joint bar 28 is supported in a rotatable manner with respect to the light emitting portion 24 and the light reception portion 25. The contact plate 27 is supported at one end of the joint bar 28 via a torsion coil spring 29. In addition, the light shielding plate 26 is fixed on substantially the middle portion of the joint bar 28 so as to be positioned between the light emitting portion 24 and the light reception portion 25.

Here, the light reception range of the light reception portion 25 will be described. As shown in FIG. 6, the light reception portion 25 of the belt sensor 21 is composed of a plurality of light receiving elements r1 to r20 (some of them and the reference characters thereof are not shown) arranged along the width direction (left-right direction in FIG. 6) of the belt. Of the light receiving elements r1 to r20, the light receiving elements r1 to r10 provided at the right with reference to a center line a detect meandering on the rear side of the belt end surface 7*a*. In addition, the light receiving elements r11 to r20 provided at the left with reference to the center line a detect meandering on the front side of the belt end surface 7*a*. It is noted that the front side is a range on the near side with reference to the center line a of the apparatus main body M in FIG. 3, and the rear side is a range on the far side with reference to the center line a of the apparatus main body M in FIG. 3.

The center line a shown in FIG. 6 corresponds to a target position of the belt end surface 7*a*. The target position of the belt end surface 7*a* is the position of the belt end surface 7*a* when the center of the intermediate transfer belt 7 in the width direction coincides with the center of the driven roller 16 in the width direction. By causing the position of the belt end surface 7*a* to coincide with the target position, the center of the intermediate transfer belt 7 in the width direction is caused to coincide with the center of the driven roller 16 in the width direction.

During rotation of the intermediate transfer belt 7, the control portion (first control portion) 100 described later controls the roller position adjustment mechanism 22 so as to cause the position of the belt end surface 7*a* to coincide with the target position, thereby correcting (hereinafter, may be referred to as "meandering correction") meandering of the intermediate transfer belt 7. By the meandering correction, position shift of a toner image when a plurality of toner images are primarily transferred onto the intermediate transfer belt 7 from the photosensitive drums 2*a*, 2*b*, 2*c*, and 2*d* is suppressed, whereby a four-full-color image with no color shift can be obtained.

When the light receiving elements r1 to r20 have received light radiated by the light emitting portion 24, the light receiving elements r1 to r20 output voltage values corresponding to the light reception amounts as the light amount detection signals to the control portion 100. When light radiated by the light emitting portion 24 is shielded by the belt end surface 7*a*, the voltage values outputted from the light receiving elements r1 to r20 also vary in accordance with the light shielded amount (light shielding position). The control portion 100 specifies the position of the belt end surface 7*a* based on the voltage values of the light amount detection signals outputted from the respective light receiving elements r1 to r20.

Specifically, for example, in FIG. 6, it will be assumed that the voltage values of the light amount detection signals outputted from the light receiving elements r1 to r18 are smaller than a predetermined threshold voltage and the voltage value of the light amount detection signal outputted from the light receiving element r19 is equal to or greater than the predetermined threshold voltage. In this case, the position of the belt end surface 7*a* is specified as being between the light receiving elements r18 and r19. In addition, in FIG. 6, it will be assumed that the voltage values of the light amount detection signals outputted from the light receiving elements r1 to r10 are smaller than the predetermined threshold voltage and the voltage value of the light amount detection signal outputted from the light receiving element r11 is equal to or greater than the predetermined threshold voltage. In this case, the position of the belt end surface 7*a* is specified as being between the light receiving elements r10 and r11 (that is, the target position).

As shown in FIG. 6, a detection range A1 (between border lines b1 and b2) in which the light receiving elements r3 to r10 provided on the rear side and the light receiving elements r11 to r18 provided on the front side receive light is a range (hereinafter, may be referred to as a "correction range" or "within correction range") for detecting normal meandering occurring on the intermediate transfer belt 7. When the belt end surface 7*a* is within the detection range A1, the control portion 100 executes first correction (meandering correction in a normal case) described later.

In addition, as shown in FIG. 6, detection ranges A2 (between border lines b1 and c1 and between border lines b2 and c2) in which the light receiving elements r1 and r2 provided on the rear side and the light receiving elements r19 and r20 provided on the front side receive light are ranges (hereinafter, may be referred to as an "allowable range" or "within allowable range") for detecting abnormal meandering occurring on the intermediate transfer belt 7. It is noted that the detection range A2 is also a range out of the detection range A1. When the belt end surface 7*a* is within the detection range A2, the control portion 100 executes second correction (meandering correction in an abnormal case) described later.

Further, as shown in FIG. 6, detection ranges A3 (outside from the border lines c1 and c2) outside from the light receiving element r1 provided on the rear side and outside from the light receiving element r20 provided on the front side are ranges (hereinafter, may be referred to as "out of allowable range") for detecting more abnormal meandering occurring on the intermediate transfer belt 7. When the belt end surface 7*a* is within the detection range A3, the control portion 100 executes processing for emergency.

In FIG. 4, when the intermediate transfer belt 7 meanders to deviate in the width direction of the belt, the contact plate 27 contacting the belt end surface 7*a* also moves in the width direction of the belt. Along with this, the light shielding plate 26 jointed with the contact plate 27 moves between the light emitting portion 24 and the light reception portion 25 (see FIG. 5). At this time, the light reception amount of light received by the light reception portion 25 varies in accordance with the light shielded amount when the light shielding plate 26 shields light radiated from the light emitting portion 24. The light reception portion 25 is electrically connected to the control portion 100. The light reception portion 25 outputs voltage values corresponding to the light reception amounts on the light receiving elements r1 to r20 (see FIG. 6) as the light amount detection signals to the control portion 100. The control portion 100 specifies the position of the belt end surface 7*a* based on the light amount detection signals outputted from the light reception portion 25.

The belt sensor 21 detects the position of the belt end surface 7*a* at predetermined time intervals. The control portion 100 controls the roller position adjustment mechanism 22 so that the position of the belt end surface 7*a* comes close to the target position (see FIG. 6) in the width direction of the belt, based on the light amount detection signals outputted from the belt sensor 21 (light reception portion 25). Thus, meandering of the intermediate transfer belt 7 is corrected. Here, the configuration of the roller position adjustment mechanism 22 will be described before the description of the control by the control portion 100.

As shown in FIG. 7, the driven roller 16 is supported such that, based on one end portion (not shown) of a rotary shaft 32, the other end portion 32*a* of the rotary shaft 32 can be inclined in a predetermined forward/reverse direction. By inclining the other end portion 32*a* of the rotary shaft 32 in the predetermined forward/reverse direction, the intermediate transfer belt 7 (belt end surface 7*a*) around the driven roller 16 can be moved in the width direction of the driven roller 16.

Therefore, by adjusting the inclination direction (upward/downward) of the rotary shaft 32 of the driven roller 16, the belt end surface 7*a* can be moved toward the front side in the width direction of the belt or toward the rear side opposite thereto.

In addition, by adjusting the inclination angle of the rotary shaft 32 of the driven roller 16, the speed of movement of the belt end surface 7*a* toward the front side in the width direction of the belt or toward the rear side opposite thereto can be changed.

As shown in FIG. 7, the roller position adjustment mechanism 22 includes, as main parts, a support frame 33, a swing support shaft 35, a cam 36, a gear 37, and a second drive motor 38. The support frame 33 is a member having a bearing 34 supporting the rotary shaft 32 of the driven roller 16 in a rotatable manner. The swing support shaft 35 is a member supporting the support frame 33 in a swingable manner. The cam 36 is a member that swings the support frame 33 based on the swing support shaft 35. The gear 37 is a member formed concentrically and integrally with the cam 36. The gear 37 and the cam 36 are supported in a rotatable manner by a support shaft (with no reference character).

The second drive motor 38 is a device that gives a rotational force to the gear 37. The second drive motor 38 is formed by a pulse motor. The second drive motor 38 is electrically connected to the control portion 100 (see FIG. 1). The control portion 100 outputs a predetermined number of drive pulses (drive signal) to the second drive motor 38, thereby driving the second drive motor 38. The second drive motor 38 has an output shaft 39 engaged with the gear 37.

The support frame 33 is a member provided in the width direction of the driven roller 16 and extending along the longitudinal direction of the intermediate transfer belt 7. The bearing 34 is provided at one end portion 33*a* of the support frame 33. In addition, the other end portion 33*b* of the support frame 33 is supported by the swing support shaft 35. The cam 36 contacts a contact portion (not shown) provided at the one end portion 33*a* of the support frame 33.

The roller position adjustment mechanism 22 configured as described above moves the belt end surface 7*a* of the intermediate transfer belt 7 in the width direction of the belt in the following manner. First, the control portion 100 outputs a predetermined number of drive pulses based on a light amount detection signal outputted from the light reception portion 25, thereby generating a drive force on the second drive motor 38. The drive force (rotational force) generated on the second drive motor 38 is transmitted to the gear 37 via the output shaft 39, whereby the gear 37 is rotated. Along with this, the cam 36 formed integrally with the gear 37 swings the one end portion 33*a* of the support frame 33 based on the swing support shaft 35. Thus, the other end portion 32*a* of the rotary shaft 32 of the driven roller 16, supported by the bearing 34, is inclined upward or downward based on the one end portion of the rotary shaft 32.

For example, if the other end portion 32*a* of the rotary shaft 32 of the driven roller 16 is moved downward on the front side, the driven roller 16 is inclined to descend from the rear side to the front side. Therefore, the intermediate transfer belt 7 gradually moves to the front side in the lowering direction along with the rotation thereof. On the other hand, if the other end portion 32*a* of the rotary shaft 32 of the driven roller 16 is moved upward on the front side, the driven roller 16 is inclined to ascend from the rear side to the front side. Therefore, the intermediate transfer belt 7 gradually moves to the rear side in the lowering direction along with the rotation thereof.

The inclination angle of the rotary shaft 32 of the driven roller 16 can be adjusted by the number of drive pulses outputted from the control portion 100 to the second drive motor 38. In addition, the rotation direction of the second drive motor 38 can be switched by the polarity (+/−) of the drive pulses being changed. By switching the rotation direction of the second drive motor 38, the inclination direction of the rotary shaft 32 of the driven roller 16 can be changed.

The greater the inclination angle of the rotary shaft 32 of the driven roller 16 is made, the faster the movement of the intermediate transfer belt 7 in the width direction becomes. In addition, when the inclination angle is adjusted, the faster the rotation speed of the drive roller 17 is made, the faster the movement of the intermediate transfer belt 7 in the width direction becomes. It is noted that control performed when the control portion 100 corrects meandering of the intermediate transfer belt 7 will be described later.

Next, the configurations of the operation portion 70, the storage portion 75, the movement mechanism portion 90, and the control portion 100 (see FIG. 2) will be described.

The operation portion 70 has a plurality of keys (not shown). The plurality of keys are operated in such a case of changing the setting or resetting a job of the printer 1, for example. When one of the keys has been operated, the operation portion 70 transmits a signal corresponding to the operated key to the control portion 100. In addition, the operation portion 70 includes a display panel which displays the state of the printer 1, a message, or the like, operation buttons such as a power key and a reset key, and the like (these are not shown).

It is noted that in order to display a message or the like on the display panel, the control portion 100 (described later) controls a display panel drive portion (not shown) to cause the display panel drive portion to supply a drive signal, a timing signal, and the like to the display panel.

The storage portion 75 is composed of a hard disk, a semiconductor memory, and the like. The storage portion 75 stores image data or the like supplied from the above-described external apparatus.

Figure 8A:
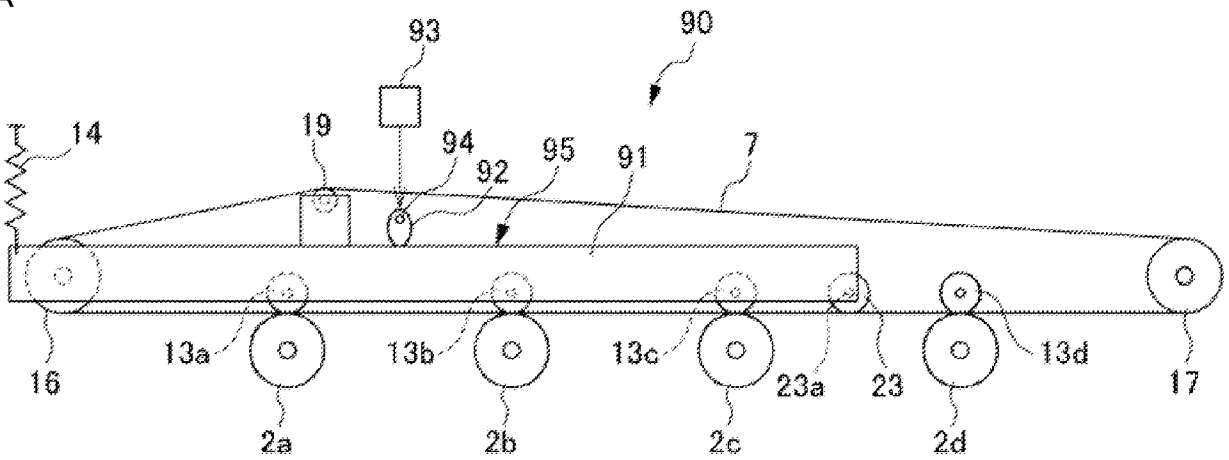
FIG. 8A is a schematic diagram showing the configuration of a movement mechanism portion.
Figure 8B:
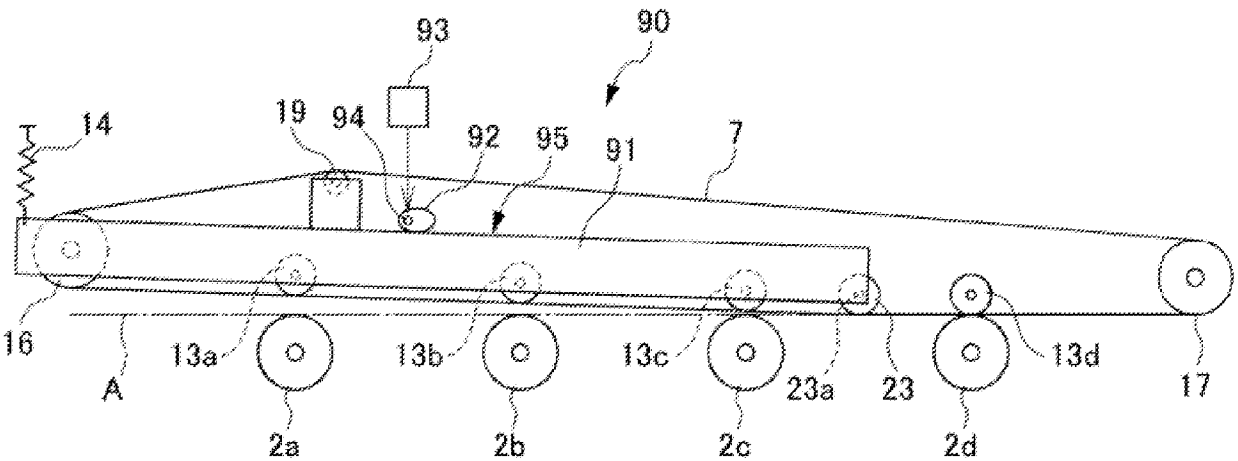
FIG. 8B is a schematic diagram showing the configuration of the movement mechanism portion.

Next, the movement mechanism portion 90 will be described. FIGS. 8A and 8B are schematic diagrams showing the configuration of the movement mechanism portion 90. In FIGS. 8A and 8B, only the configurations of the movement mechanism portion 90 and the peripheral part are shown, and the other configuration is not shown. In addition, in FIGS. 8A and 8B, the same constituent elements as those in FIGS. 1 and 2 are denoted by the same reference characters.

The movement mechanism portion 90 includes a frame 91, an eccentric cam 92, and a third drive motor 93.

The frame 91 is a frame member formed substantially in a rectangular U-shape in planar view. The frame 91 supports the primary transfer rollers 13*a*, 13*b*, and 13*c*, the driven roller 16, the drive roller 17, and the tension roller 19 in a rotatable manner, at both ends of each roller in the width direction. The frame 91 is supported so as to be rotatable around a rotary shaft 23*a* of the support roller 23.

In addition, the frame 91 is energized by a spring 14 as an energizing member in the clockwise direction around the rotary shaft 23*a* of the support roller 23. The support roller 23 has a function of supporting the frame 91 via the rotary shaft 23*a*, and a function of retaining the primary transfer nip N1*d* upon formation of a monochrome toner image.

The eccentric cam 92 is a member for moving the frame 91 to a contact position or a separation position (described later), and fixing the frame 91 at the contact position or the separation position. As shown in FIG. 8, the eccentric cam 92 is provided in contact with an upper end portion 95 of the frame 91. The eccentric cam 92 is supported in a rotatable manner by a cam rotary shaft 94. In addition, the eccentric cam 92 rotates clockwise or counterclockwise by a rotational force given by the third drive motor 93.

The third drive motor 93 is a device that gives a rotational force to the eccentric cam 92. The third drive motor 93 is electrically connected to the control portion 100 (described later). The rotation of the third drive motor 93 is controlled by a drive signal outputted from the control portion 100.

In the case where four-full-color printing is performed in the printer 1, a rotational force is given from the third drive motor 93 to the eccentric cam 92, to rotate the eccentric cam 92 to a first position at which the major axis direction of the eccentric cam 92 is substantially perpendicular to the intermediate transfer belt 7. When the eccentric cam 92 has rotated to the first position, the frame 91 pressed by the eccentric cam 92 rotates counterclockwise around the rotary shaft 23*a* of the support roller 23 against the energizing force of the spring 14.

As a result, as shown in FIG. 8A, the intermediate transfer belt 7 contacts the photosensitive drums 2*a*, 2*b*, and 2*c*. Hereinafter, a position where the intermediate transfer belt 7 contacts the photosensitive drums 2*a*, 2*b*, and 2*c* when the positions of the primary transfer rollers 13*a*, 13*b*, and 13*c* are changed may be referred to as a "contact position". It is noted that the primary transfer roller 13*d* always causes the intermediate transfer belt 7 to contact the photosensitive drum 2*d*. Therefore, when the intermediate transfer belt 7 is moved to the contact position where the intermediate transfer belt 7 contacts the photosensitive drums 2*a*, 2*b*, and 2*c*, the intermediate transfer belt 7 contacts all the photosensitive drums 2*a*, 2*b*, 2*c*, and 2*d*. Therefore, movement of the intermediate transfer belt 7 to the contact position enables four-full-color printing in the printer 1.

On the other hand, in the case where monochrome printing is performed in the printer 1, a rotational force is given from the third drive motor 93 to the eccentric cam 92, to rotate the eccentric cam 92 to a second position at which the minor axis direction of the eccentric cam 92 is substantially perpendicular to the intermediate transfer belt 7. When the eccentric cam 92 has rotated to the second position, the frame 91 rotates clockwise around the rotary shaft 23*a* of the support roller 23 by the energizing force of the spring 14.

As a result, as shown in FIG. 8B, the intermediate transfer belt 7 is separated from the plurality of photosensitive drums 2*a*, 2*b*, and 2*c*. Hereinafter, a position where the intermediate transfer belt 7 is separated from the photosensitive drums 2*a*, 2*b*, and 2*c* when the positions of the primary transfer rollers 13*a*, 13*b*, and 13*c* are changed may be referred to as a "separation position". It is noted that a line A shown in FIG. 8B indicates the position of the intermediate transfer belt 7 in the case of contact position. As described above, the primary transfer roller 13*d* always causes the intermediate transfer belt 7 to contact the photosensitive drum 2*d*. Therefore, when the intermediate transfer belt 7 is moved to the separation position where the intermediate transfer belt 7 are separated from the photosensitive drums 2*a*, 2*b*, and 2*c*, the intermediate transfer belt 7 contacts only the photosensitive drum 2*d*. Therefore, movement of the intermediate transfer belt 7 to the separation position enables monochrome printing in the printer 1.

Next, the control portion 100 will be described. The control portion 100 includes a CPU, a RAM, and a ROM (not shown). The RAM is a storage device having a function of temporarily storing various types of data and a function as a working area upon calculation. The ROM is a storage device having a function as a flash memory for storing various programs. The CPU is a computing device that reads a program from the ROM and executes the program. The CPU, and the RAM and the ROM receive and transmit data with each other via a data bus (not shown). The CPU executes a program read from the ROM and thereby executes processing in accordance with the content of the program. In addition, the control portion 100 has a timer function (hereinafter, may be referred to as a "timer") of counting time.

The control portion 100 controls the belt device 20, the image forming portion 30, the sheet feed/discharge portion 40, and the movement mechanism portion 90. In addition, the control portion 100 has functions as a first control portion and a second control portion described later. Hereinafter, the control portion 100 when functioning as the first control portion is referred to as a "control portion (first control portion) 100", and the control portion 100 when functioning as the second control portion is referred to as a "control portion (second control portion) 100".

The control portion (first control portion) 100 determines an inclination direction and an inclination angle of the rotary shaft of the driven roller 16, based on a light amount detection signal (position information about the transfer belt) outputted from the belt sensor 21 (acquired by the position information acquiring portion), and controls the roller position adjustment mechanism 22 so that the rotary shaft of the driven roller 16 will be directed in the inclination direction at the inclination angle.

Specifically, in the case where the position of the intermediate transfer belt 7 specified based on a light amount detection signal outputted from the belt sensor 21 is within the correction range (detection range A1: see FIG. 6), the control portion (first control portion) 100 controls the roller position adjustment mechanism 22 so as to return the intermediate transfer belt 7 to a predetermined target position (corresponding to the center line a: see FIG. 6). Hereinafter, meandering correction in the case (normal case) where the position of the intermediate transfer belt 7 is within the correction range may be referred to as "first correction".

In addition, in the case where the position of the intermediate transfer belt 7 specified based on a light amount detection signal outputted from the belt sensor 21 is out of the correction range and within the allowable range (detection range A2: see FIG. 6), the control portion (first control portion) 100 controls the roller position adjustment mechanism 22 so as to return the intermediate transfer belt 7 to the predetermined target position, and controls the first drive motor 18 so as to make the rotation speed of the drive roller 17 faster than in the first correction. Hereinafter, meandering correction in the case (abnormal case) where the position of the intermediate transfer belt 7 is out of the correction range and within the allowable range may be referred to as "second correction".

It is noted that the control portion (first control portion) 100 determines an inclination direction and an inclination angle of the rotary shaft of the driven roller 16 by referring to a data table (ROM) on which light amount detection signals (voltage values) outputted from the belt sensor 21 are respectively associated with inclination directions and inclination angles of the rotary shaft of the driven roller 16 that are required for returning the intermediate transfer belt 7 to the predetermined target position.

In addition, upon the control for the roller position adjustment mechanism 22 in order to return the intermediate transfer belt 7 to the predetermined target position in the second correction, the control portion (first control portion) 100 controls the roller position adjustment mechanism 22 so as to make the inclination angle of the rotary shaft of the driven roller 16 greater than that in the first correction.

In addition, in the emergency case where the position of the intermediate transfer belt 7 specified based on a light amount detection signal outputted from the belt sensor 21 is out (detection range A3: see FIG. 6) of the allowable range, the control portion (first control portion) 100 controls the first drive motor 18 so as to stop the rotation of the drive roller 17.

Further, in the case where, even though the roller position adjustment mechanism 22 is controlled by the function of the first control portion, the intermediate transfer belt 7 does not return into the correction range centered on the target position within a time t1 (predetermined time) and is out of the correction range, the control portion (second control portion)

100 controls the movement mechanism portion 90 so as to change the positions of the primary transfer rollers 13*a*, 13*b*, and 13*c* (a plurality of second opposing portions).

Specifically, in the state in which the primary transfer rollers 13*a*, 13*b*, and 13*c* (a plurality of second opposing portions) are positioned at the contact positions, in the case where, even though the roller position adjustment mechanism 22 is controlled in accordance with the inclination direction and the inclination angle (correction information) of the rotary shaft of the driven roller 16 by the function of the first control portion, the intermediate transfer belt 7 does not return into the correction range within the time t1 (predetermined time) and is out of the correction range, the control portion (second control portion) 100 controls the movement mechanism portion 90 so as to move the primary transfer rollers 13*a*, 13*b*, and 13*c* to the separation positions.

In addition, in the state in which the primary transfer rollers 13*a*, 13*b*, and 13*c* (a plurality of second opposing portions) are positioned at the separation positions, in the case where, even though the roller position adjustment mechanism 22 is controlled in accordance with the inclination direction and the inclination angle (correction information) of the rotary shaft of the driven roller 16 by the function of the first control portion, the intermediate transfer belt 7 does not return into the correction range within the time t1 (predetermined time) and is out of the correction range, the control portion (second control portion) 100 controls the movement mechanism portion 90 so as to move the primary transfer rollers 13*a*, 13*b*, and 13*c* to the contact positions.

In addition, if the intermediate transfer belt 7 has returned to the correction range by the control for the movement mechanism portion 90 which has changed the positions of the primary transfer rollers 13*a*, 13*b*, and 13*c* (a plurality of second opposing portions), the control portion (second control portion) 100 controls the movement mechanism portion 90 so as to retain the changed positions of the primary transfer rollers 13*a*, 13*b*, and 13*c*.

The functions of the control portion 100 as the first control portion and the second control portion described above will be described later with reference to the flowchart.

Next, the operation of the printer 1 configured as described above will be described. First, with reference to FIG. 1, the fundamental operation of the printer 1 will be described.

(Operation in Case of Performing One-Side Printing on Paper Sheet T)

A paper sheet T contained in the sheet feed cassette 52 is fed to the first conveyance path L1 by the forward feed roller 55 and the sheet feed roller pair 81, and then conveyed to the registration roller pair 80 through the first merging portion P1 and the first conveyance path L1 by the first conveying roller pair 82.

On the registration roller pair 80, skew correction of the paper sheet T and timing adjustment in accordance with formation of a toner image in the image forming portion 30 are performed.

The paper sheet T discharged from the registration roller pair 80 is introduced through the first conveyance path L1 to a portion (the secondary transfer nip N2) between the intermediate transfer belt 7 and the secondary transfer roller 8. Then, a toner image is transferred onto the paper sheet T between the intermediate transfer belt 7 and the secondary transfer roller 8.

Thereafter, the paper sheet T is discharged from between the intermediate transfer belt 7 and the secondary transfer roller 8, and then introduced through the second conveyance path L2 to a fixing nip between the heating rotary body 60*a* and the pressurizing rotary body 60*b* in the fixing portion 60. Then, at the fixing nip, a toner is melted and fixed on the paper sheet T.

Next, the paper sheet T is conveyed through the third conveyance path L3 to the sheet discharge portion 61, and discharged from the sheet discharge portion 61 to the discharged sheet accumulation portion M1 by the discharge roller pair 53. Thus, the one-side printing of the paper sheet T contained in the sheet feed cassette 52 is completed.

On the other hand, in the case of performing one-side printing on a paper sheet T placed on the manual tray 65, the paper sheet T placed on the manual tray 65 is fed through the manual conveyance path La by the sheet feed roller 66, and then conveyed through the first merging portion P1 and the first conveyance path L1 to the registration roller pair 80. The operation performed thereafter is the same as the above-described operation of the one-side printing on a paper sheet T contained in the sheet feed cassette 52, and therefore the description thereof is omitted.

(Operation in Case of Performing Both-Side Printing on Paper Sheet T)

In the case of one-side printing, as described above, a paper sheet T on which one-side printing has been performed is discharged from the sheet discharge portion 61 to the discharged sheet accumulation portion M1, and thus the printing operation is completed.

On the other hand, in the case of performing both-side printing, a paper sheet T on which one-side printing has been performed is inverted from the side for the one-side printing and conveyed again to the registration roller pair 80 through the return conveyance path Lb, whereby both-side printing is to be performed for the paper sheet T.

In detail, the operation until the paper sheet T on which one-side printing has been performed is discharged from the sheet discharge portion 61 by the discharge roller pair 53 is the same as the operation for the one-side printing described above. However, in the case of both-side printing, in the state in which the paper sheet T on which one-side printing has been performed is held by the discharge roller pair 53, rotation of the discharge roller pair 53 is stopped and then the discharge roller pair 53 is caused to rotate in the reverse direction. If the discharge roller pair 53 is thus rotated in the reverse direction, the paper sheet T held by the discharge roller pair 53 is conveyed in the reverse direction (direction from the sheet discharge portion 61 to the first branching portion Q1) through the third conveyance path L3.

As described above, if the paper sheet T is conveyed in the reverse direction through the third conveyance path L3, the paper sheet T is rectified into the return conveyance path Lb by the rectification member 58, and then merges into the first conveyance path L1 via the second merging portion P2. Here, the paper sheet T has been inverted from the side for the one-side printing.

Further, the paper sheet T is subjected to the correction or the adjustment by the registration roller pair 80, and then introduced through the first conveyance path L1 into the secondary transfer nip N2. Since a side of the paper sheet T on which printing has not been performed yet faces to the intermediate transfer belt 7 as a result of passing through the return conveyance path Lb, a toner image is transferred onto the side on which printing has not been performed yet, whereby both-side printing is performed.

Figure 9:
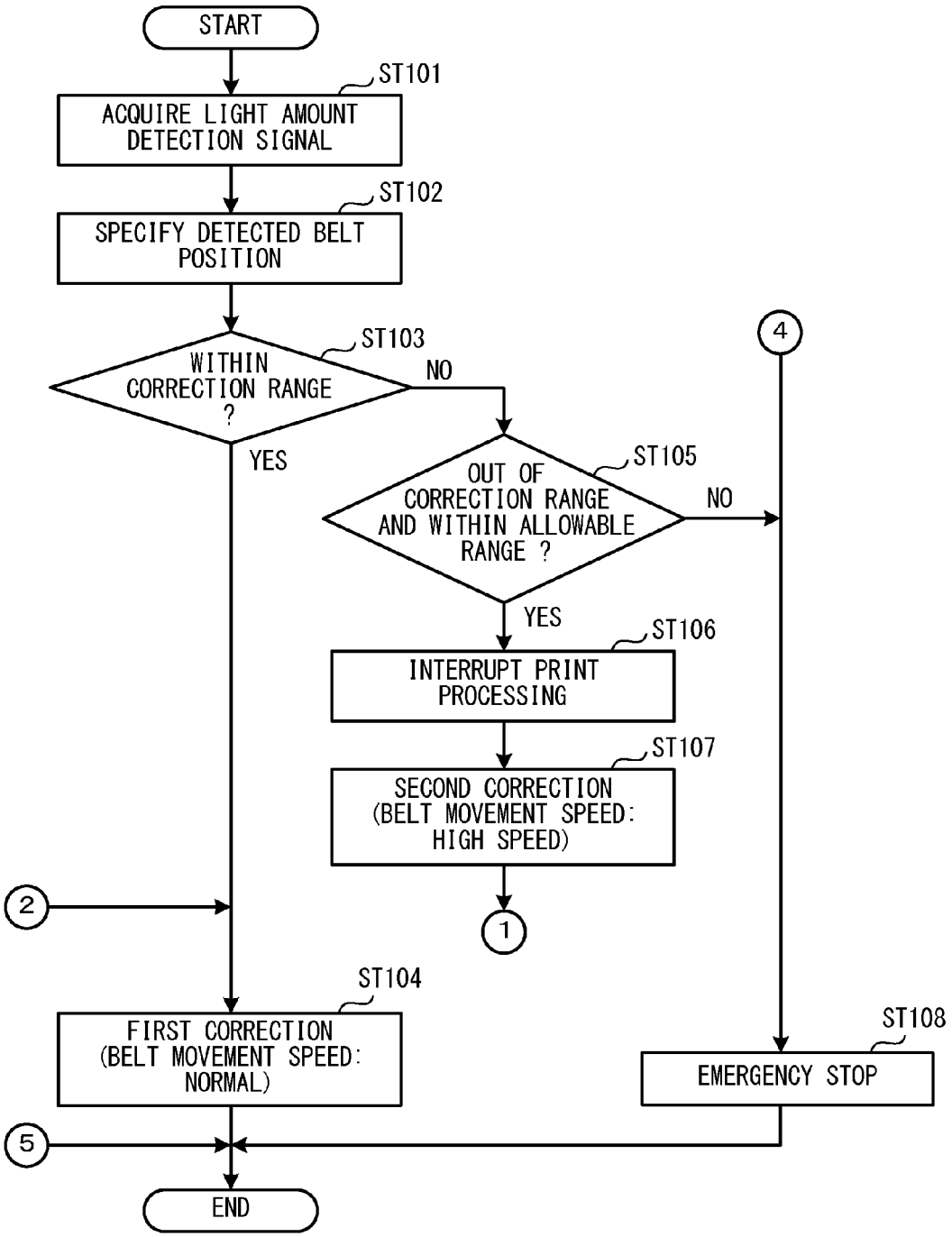
FIG. 9 is a flowchart showing a processing procedure when a control portion (first control portion and second control portion) executes meandering correction for an intermediate transfer belt.
Figure 10:
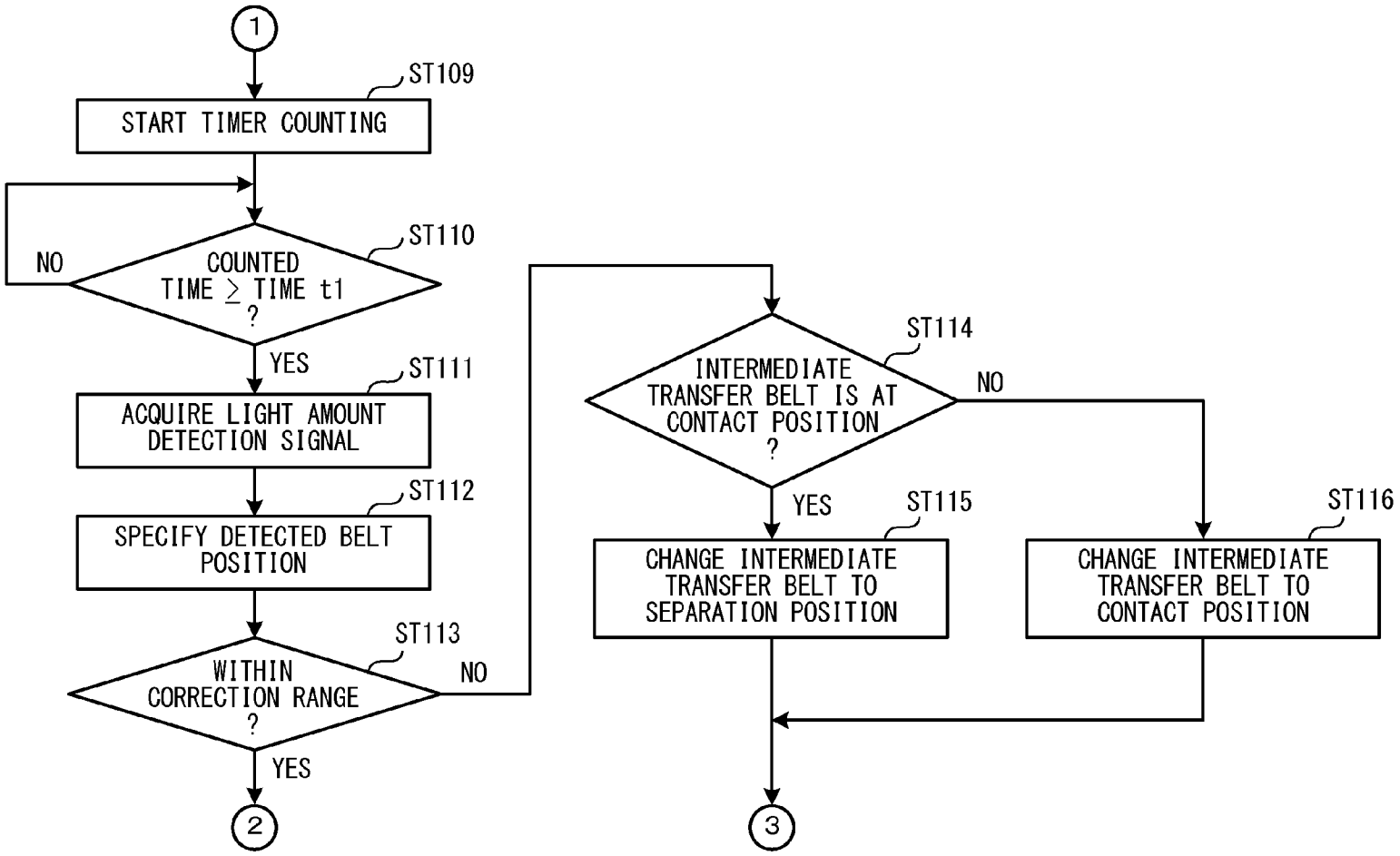
FIG. 10 is a flowchart showing a processing procedure when the control portion (first control portion and second control portion) executes meandering correction for the intermediate transfer belt.
Figure 11:
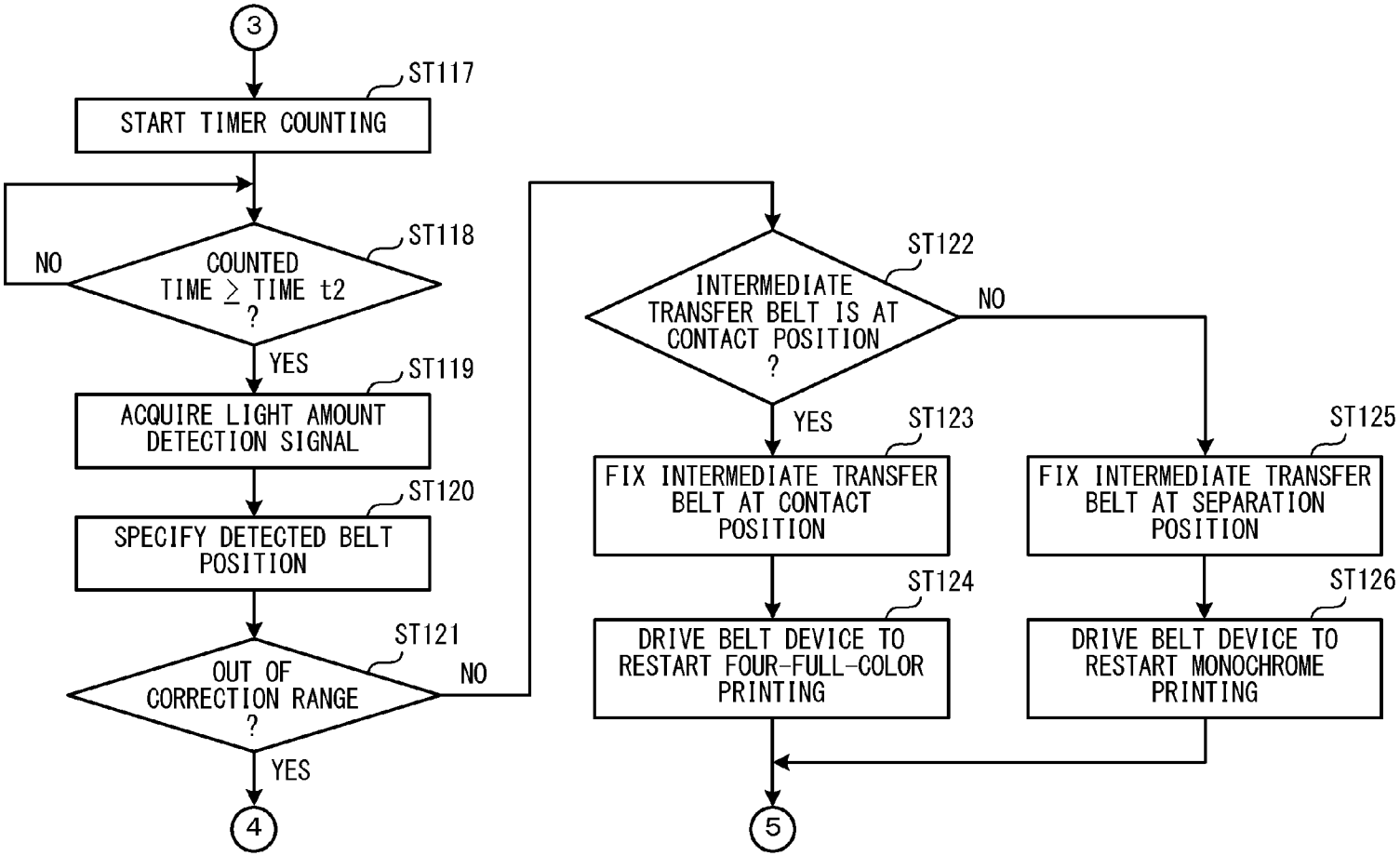
FIG. 11 is a flowchart showing a processing procedure when the control portion (first control portion and second control portion) executes meandering correction for the intermediate transfer belt.

Next, the processing procedure in the case where the control portion (first control portion and second control portion) 100 executes meandering correction for the intermediate transfer belt 7 will be described. FIGS. 9, 10, and 11 are flowcharts showing the processing procedure in the case where the control portion (first control portion and second control portion) 100 executes meandering correction for the intermediate transfer belt 7. The processing of the flowcharts shown in FIGS. 9 to 11 is repeatedly executed at predetermined time intervals during operation of the printer 1.

In step ST101 shown in FIG. 9, the control portion (first control portion) 100 acquires a light amount detection signal from the light reception portion 25 (belt sensor 21).

In step ST102, the control portion (first control portion) 100 specifies the position (hereinafter, may be referred to as a "detected belt position") of the belt end surface 7*a* of the intermediate transfer belt 7 based on the acquired light amount detection signal.

In step ST103, the control portion (first control portion) 100 determines whether or not the detected belt position is within the correction range (detection range A1). In step ST103, if the control portion (first control portion) 100 has determined that the detected belt position is within the correction range (YES), the control portion (first control portion) 100 advances the process to step ST104. On the other hand, in step ST103, if the control portion (first control portion) 100 has determined that the detected belt position is out of the correction range (NO), the control portion (first control portion) 100 advances the process to step ST105.

In step ST104 (determined YES in step ST103), the control portion (first control portion) 100 executes the first correction (meandering correction in a normal case), whereby the process of the present flowchart is ended. In the first correction, the control portion (first control portion) 100 determines a drive direction and a drive amount of the second drive motor 38 in accordance with the detected belt position, and outputs a drive signal with a drive pulse number corresponding to the drive direction and the drive amount, to the second drive motor 38. In addition, the control portion (first control portion) 100 controls the rotation speed of the first drive motor 18 so that the rotation speed (belt movement speed) of the drive roller 17 will become a speed for the first correction. Therefore, the intermediate transfer belt 7 rotates at the movement speed for the first correction.

On the other hand, in step ST105 (determined NO in step ST103), the control portion (first control portion) 100 determines whether or not the detected belt position is out of the correction range (detection range A1) and within the allowable range (detection range A2). In step ST105, if the control portion (first control portion) 100 has determined that the detected belt position is out of the correction range and within the allowable range (YES), the control portion (first control portion) 100 advances the process to step ST106. On the other hand, in step ST105, if the control portion (first control portion) 100 has determined that the detected belt position is out of the correction range and not within the allowable range (NO), the control portion (first control portion) 100 advances the process to step ST108.

In step ST106 (determined YES in step ST105), the control portion (first control portion) 100 controls the belt device 20 to stop output of a drive signal to the first drive motor 18, whereby the printer 1 interrupts print processing. At the same time, the control portion (first control portion) 100 controls the display panel drive portion (not shown) to display, on the display panel (not shown) of the operation portion 70, a message for notifying that the print processing is interrupted because meandering correction for the belt is being performed.

In step ST107, the control portion (first control portion) 100 executes the second correction (meandering correction in an abnormal case). Specifically, the control portion (first control portion) 100 sets a drive amount of the second drive motor 38 to the maximum value irrespective of the detected belt position, and outputs a drive signal with a drive pulse number corresponding to the maximum drive amount, to the second drive motor 38. As a result, the inclination angle of the rotary shaft 32 of the driven roller 16 becomes greater than the inclination angle set for the first correction.

In addition, in step ST107, the control portion (first control portion) 100 controls the rotation speed of the first drive motor 18 to the maximum value so that the rotation speed (belt movement speed) of the drive roller 17 will become faster than that for the first correction. As a result, the rotation speed of the first drive motor 18 becomes faster than that for the first correction. Therefore, the intermediate transfer belt 7 rotates at a speed (high speed) faster than the movement speed for the first correction.

On the other hand, in step ST108 (determined NO in step ST105), the control portion (first control portion) 100 executes processing for emergency. Specifically, the control portion (first control portion) 100 controls the belt device 20 to stop output of a drive signal to the first drive motor 18, whereby the printer 1 interrupts print processing (emergency stop). At the same time, the control portion (first control portion) 100 controls the display panel drive portion (not shown) to display, on the display panel (not shown) of the operation portion 70, a message for notifying that the print processing is interrupted because of abnormal meandering of the belt. Then, the process of the present flowchart is ended.

It is noted that in step ST108, the control portion (first control portion) 100 may control the display panel drive portion (not shown) to display, on the display panel of the operation portion 70, a message for notifying that inspection by a maintenance staff is needed, together with the message for notifying that the print processing is interrupted.

In step ST109 shown in FIG. 10, the control portion (second control portion) 100 activates a timer (not shown) to start counting the time t1.

In step ST110, the control portion (second control portion) 100 determines whether or not the time counted by the timer has reached the time t1. In the determination of step ST110, if the control portion (second control portion) 100 has determined that the time counted by the timer has reached the time t1 (YES), the control portion (second control portion) 100 advances the process to step ST111. It is noted that the count of the timer is reset when the time counted by the timer has reached the time t1.

On the other hand, in the determination of step ST110, if the control portion (second control portion) 100 has determined that the time counted by the timer has not reached the time t1 yet (NO), the control portion (second control portion) 100 returns the process to step ST110.

In step ST111 (determined YES in step ST110), the control portion (second control portion) 100 acquires a light amount detection signal from the light reception portion 25 (belt sensor 21).

In step ST112, the control portion (second control portion) 100 specifies the detected belt position of the intermediate transfer belt 7 based on the acquired light amount detection signal.

In step ST113, the control portion (second control portion) 100 determines whether or not the detected belt position is within the correction range (detection range A1). In step ST113, if the control portion (second control portion) 100 has determined that the detected belt position is within the correction range (YES), the control portion (second control portion) 100 advances the process to step ST104 (see FIG. 9). On the other hand, in step ST113, if the control portion (second control portion) 100 has determined that the detected belt position is out of the correction range (NO), the control portion (second control portion) 100 advances the process to step ST114.

In step ST114 (determined NO in step ST113), the control portion (second control portion) 100 determines whether or not the intermediate transfer belt 7 is positioned at the contact position where the intermediate transfer belt 7 contacts the photosensitive drums 2*a*, 2*b*, and 2*c*. In step ST114, if the control portion (second control portion) 100 has determined that the intermediate transfer belt 7 is positioned at the contact position (YES), the control portion (second control portion) 100 advances the process to step ST115. On the other hand, in step ST114, if the control portion (second control portion) 100 has determined that the intermediate transfer belt 7 is not positioned at the contact position (NO), that is, is positioned at the separation position, the control portion (second control portion) 100 advances the process to step ST116.

In step ST115 (YES in step ST114), the control portion (second control portion) 100 controls the movement mechanism portion 90 to change the position of the intermediate transfer belt 7 from the contact position to the separation position (move the primary transfer rollers 13*a* to 13*c* to the separation positions).

In step ST116 (NO in step ST114), the control portion (second control portion) 100 controls the movement mechanism portion 90 to change the position of the intermediate transfer belt 7 from the separation position to the contact position (move the primary transfer rollers 13*a* to 13*c* to the contact positions).

In step ST117 shown in FIG. 11, the control portion (second control portion) 100 activates the timer (not shown) to start counting a time t2.

In step ST118, the control portion (second control portion) 100 determines whether or not the time counted by the timer has reached the time t2. In the determination of step ST118, if the control portion (second control portion) 100 has determined that the time counted by the timer has reached the time t2 (YES), the control portion (second control portion) 100 advances the process to step ST119. It is noted that the count of the timer is reset when the time counted by the timer has reached the time t2.

On the other hand, in the determination of step ST118, if the control portion (second control portion) 100 has determined that the time counted by the timer has not reached the time t2 yet (NO), the control portion (second control portion) 100 returns the process to step ST118.

In step ST119 (YES in step ST118), the control portion (second control portion) 100 acquires a light amount detection signal from the light reception portion 25 (belt sensor 21).

In step ST120, the control portion (second control portion) 100 specifies the detected belt position of the intermediate transfer belt 7 based on the acquired light amount detection signal.

In step ST121, the control portion (second control portion) 100 determines whether or not the detected belt position is out of the correction range (detection range A1). In step ST121, if the control portion (second control portion) 100 has determined that the detected belt position is out of the correction range (YES), the control portion (second control portion) 100 advances the process to step ST108 (see FIG. 9). Thus, in the case where, even after the position of the intermediate transfer belt 7 is changed, the detected belt position of the intermediate transfer belt 7 does not return into the correction range, the control portion (second control portion) 100 advances the process to step ST108, to execute processing of emergency stop.

On the other hand, in step ST121, if the control portion (second control portion) 100 has determined that the detected belt position is within the correction range (NO), the control portion (second control portion) 100 advances the process to step ST122.

In step ST122 (NO in step ST121), the control portion (second control portion) 100 determines whether or not the intermediate transfer belt 7 is positioned at the contact position where the intermediate transfer belt 7 contacts the photosensitive drums 2*a*, 2*b*, and 2*c*. In step ST122, if the control portion (second control portion) 100 has determined that the intermediate transfer belt 7 is positioned at the contact position (YES), the control portion (second control portion) 100 advances the process to step ST123. On the other hand, in step ST122, if the control portion (second control portion) 100 has determined that the intermediate transfer belt 7 is not positioned at the contact position (NO), that is, is positioned at the separation position, the control portion (second control portion) 100 advances the process to step ST125.

In step ST123 (YES in step ST122), the control portion (second control portion) 100 fixes the position of the intermediate transfer belt 7 at the contact position. Specifically, the control portion (second control portion) 100 retains the status of a flag set in a predetermined area of the RAM and indicating that the intermediate transfer belt 7 has moved to the contact position.

In step ST124, the control portion (second control portion) 100 sets the print mode to four-full-color printing, and controls the belt device 20 to output a drive signal to the first drive motor 18. Thus, in the printer 1, the belt device 20 is driven and four-full-color printing is restarted. At the same time, the control portion (second control portion) 100 controls the display panel drive portion (not shown) to display, on the display panel (not shown) of the operation portion 70, a message for informing that four-full-color printing is able to be performed, whereby the process of the present flowchart is ended.

On the other hand, in step ST125 (NO in step ST122), the control portion (second control portion) 100 fixes the position of the intermediate transfer belt 7 at the separation position. Specifically, the control portion (second control portion) 100 retains the status of a flag set in a predetermined area of the RAM and indicating that the intermediate transfer belt 7 has moved to the separation position.

In step ST126, the control portion (second control portion) 100 sets the print mode to monochrome printing, and controls the belt device 20 to output a drive signal to the first drive motor 18. Thus, in the printer 1, the belt device 20 is driven and monochrome printing is restarted. At the same time, the control portion (second control portion) 100 controls the display panel drive portion (not shown) to display, on the display panel (not shown) of the operation portion 70, a message for informing that monochrome printing is able to be performed, whereby the process of the present flowchart is ended.

It is noted that in steps ST124 and ST126, the control portion (second control portion) 100 may control the display panel drive portion (not shown) to display, on the display panel of the operation portion 70, a message for notifying that inspection by a maintenance staff is needed, together with the message for notifying that four-full-color printing or monochrome printing is able to be performed.

Next, a specific example in which the control portion (first control portion and second control portion) 100 performs meandering correction for the intermediate transfer belt 7 based on the process of the flowcharts shown in FIGS. 9 to 11 will be described.

First, the case where the intermediate transfer belt 7 falls within the correction range by the second correction (meandering correction in an abnormal case) will be described.

Figure 12:
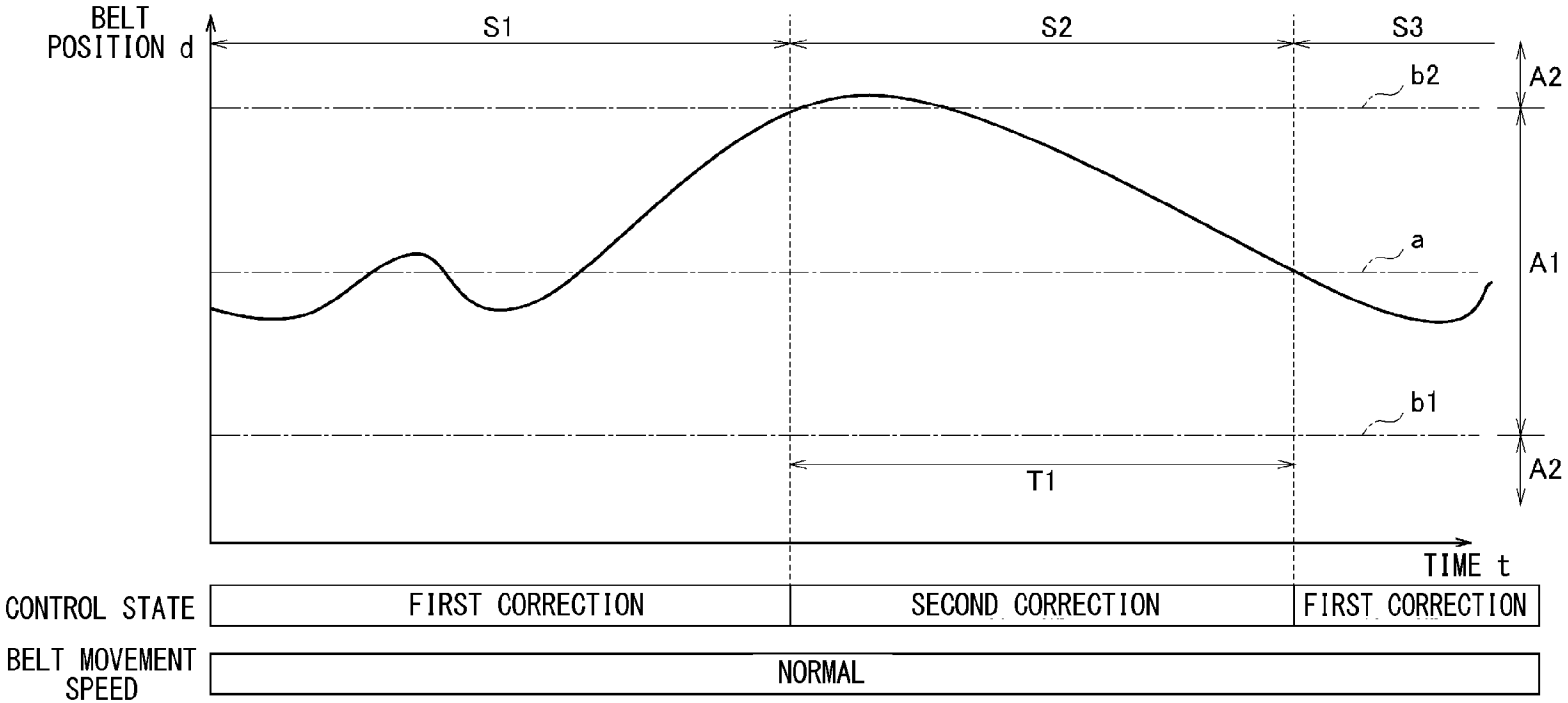
FIG. 12 is a graph showing transition of a belt end surface in the case of executing conventional meandering correction in which a belt movement speed is fixed.
Figure 13:
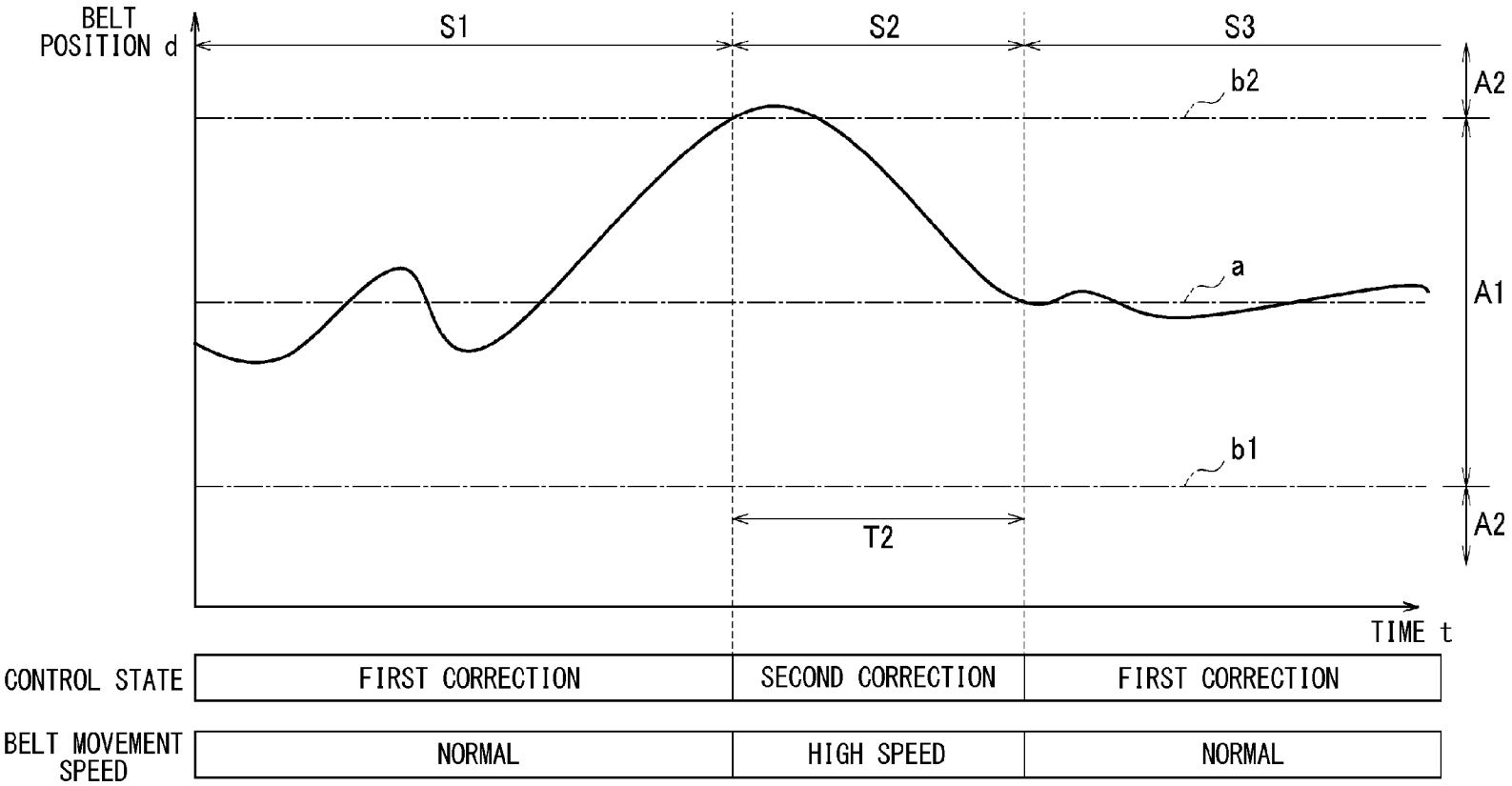
FIG. 13 is a graph showing transition of a belt end surface in the case of executing meandering correction of the embodiment.

FIG. 12 is a graph showing transition of the belt end surface 7*a* in the case of performing conventional meandering correction with a fixed belt movement speed. FIG. 13 is a graph showing transition of the belt end surface 7*a* in the case of performing meandering correction of the present embodiment. In FIGS. 12 and 13, the horizontal axis indicates a time t and the vertical axis indicates a belt position d (position of the belt end surface 7*a*).

It is noted that dotted-dashed lines "a", "b1" and "b2" shown in FIGS. 12 and 13 correspond to the center line a and the border lines b1 and b2 shown in FIG. 6, respectively. Therefore, downward transition from the center line a in the graph indicates movement of the belt end surface 7*a* toward the rear side, and upward transition from the center line a in the graph indicates movement of the belt end surface 7*a* toward the front side. In FIGS. 12 and 13, in an interval S2, the intermediate transfer belt 7 meanders to greatly deviate toward the front side (the same holds true for FIGS. 14 and 15 described later).

As shown in FIGS. 12 and 13, when the position of the belt end surface 7*a* of the intermediate transfer belt 7 is within the correction range (detection range A1) (interval S1), the first correction is executed. In this case, in both FIGS. 12 and 13, the rotation speed (belt movement speed) of the drive roller 17 becomes the rotation speed for the first correction.

In addition, when the position of the belt end surface 7*a* of the intermediate transfer belt 7 is out of the correction range (detection range A1) and within the allowable range (detection range A2) (interval S2), the second correction (meandering correction in an abnormal case) is executed. Here, in the conventional meandering correction (see FIG. 12), the rotation speed (belt movement speed) of the drive roller 17 remains the rotation speed for the first correction. Therefore, a time T1 is required until the meandering correction for the second correction is finished and the meandering correction for the first correction (interval S3) is reached.

On the other hand, in the meandering correction (see FIG. 13) of the present embodiment, the rotation speed (belt movement speed) of the drive roller 17 becomes a rotation speed (high speed) faster than the rotation speed for the first correction. Therefore, a time T2 (<time T1) is required until the second correction is finished and the meandering correction for the first correction (interval S3) is reached.

Thus, the meandering correction of the present embodiment shown in FIG. 13 can swiftly return the meandering intermediate transfer belt 7 to the target position by the second correction (interval S2). Accordingly, color shift of a toner image is resolved in a short time, and therefore reduction in productivity of printed matters can be suppressed to the minimum. In addition, in the second correction, since the second drive motor 38 is driven at the maximum drive amount irrespective of the detected position of the belt end surface 7*a*, the meandering intermediate transfer belt 7 can be further swiftly returned to the target position. Further, in the emergency case where the position of the belt end surface 7*a* of the intermediate transfer belt 7 detected by the belt sensor 21 is out of the allowable range, driving of the drive roller 17 is stopped, whereby a trouble that the intermediate transfer belt 7 comes off from the driven roller 16 can be prevented in advance.

Next, the case where the intermediate transfer belt 7 does not fall within the correction range even after the second correction is performed for a predetermined time will be described.

Figure 14:
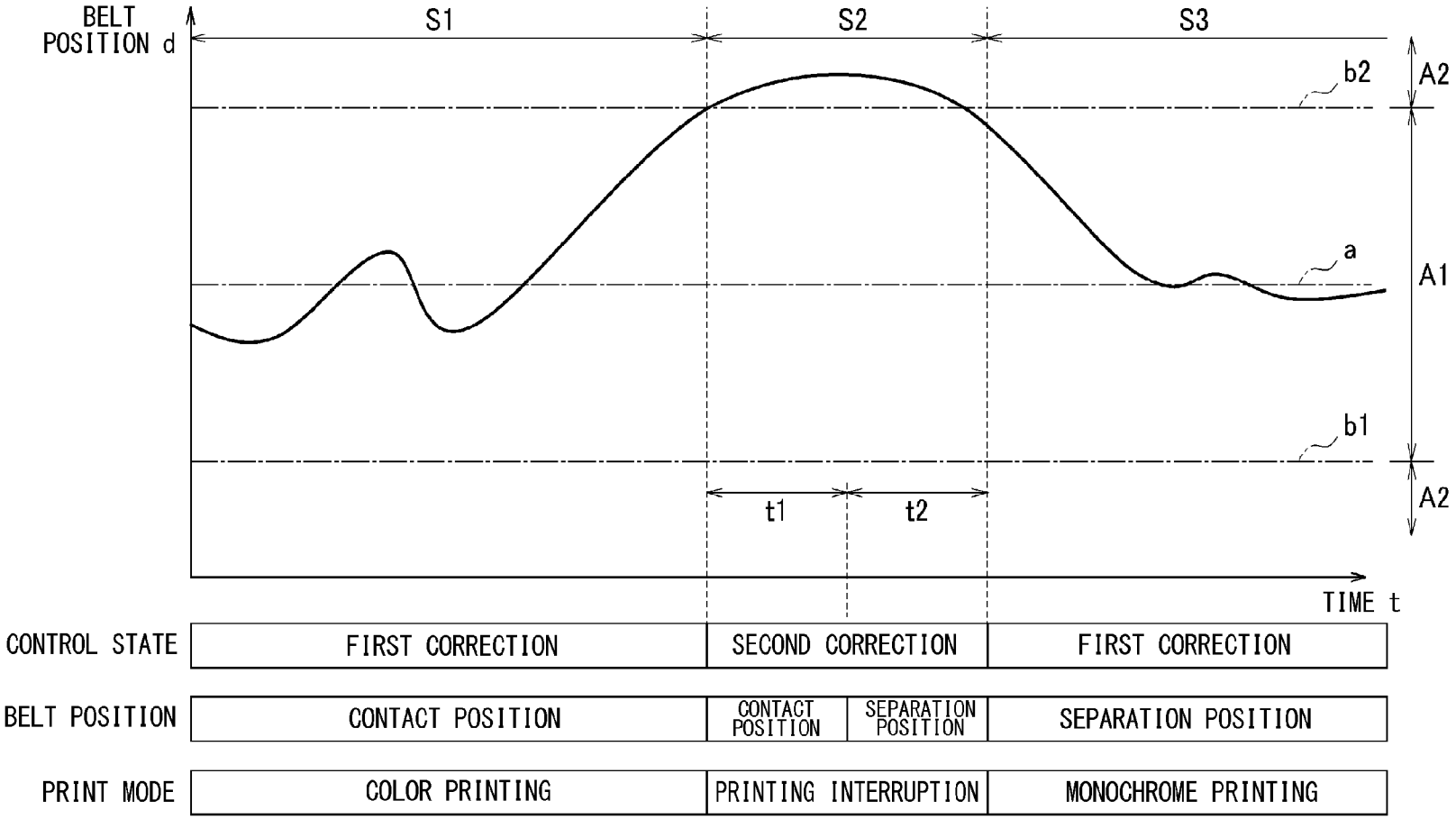
FIG. 14 is a graph showing transition of the belt end surface in the case of executing meandering correction during four-full-color printing.
Figure 15:
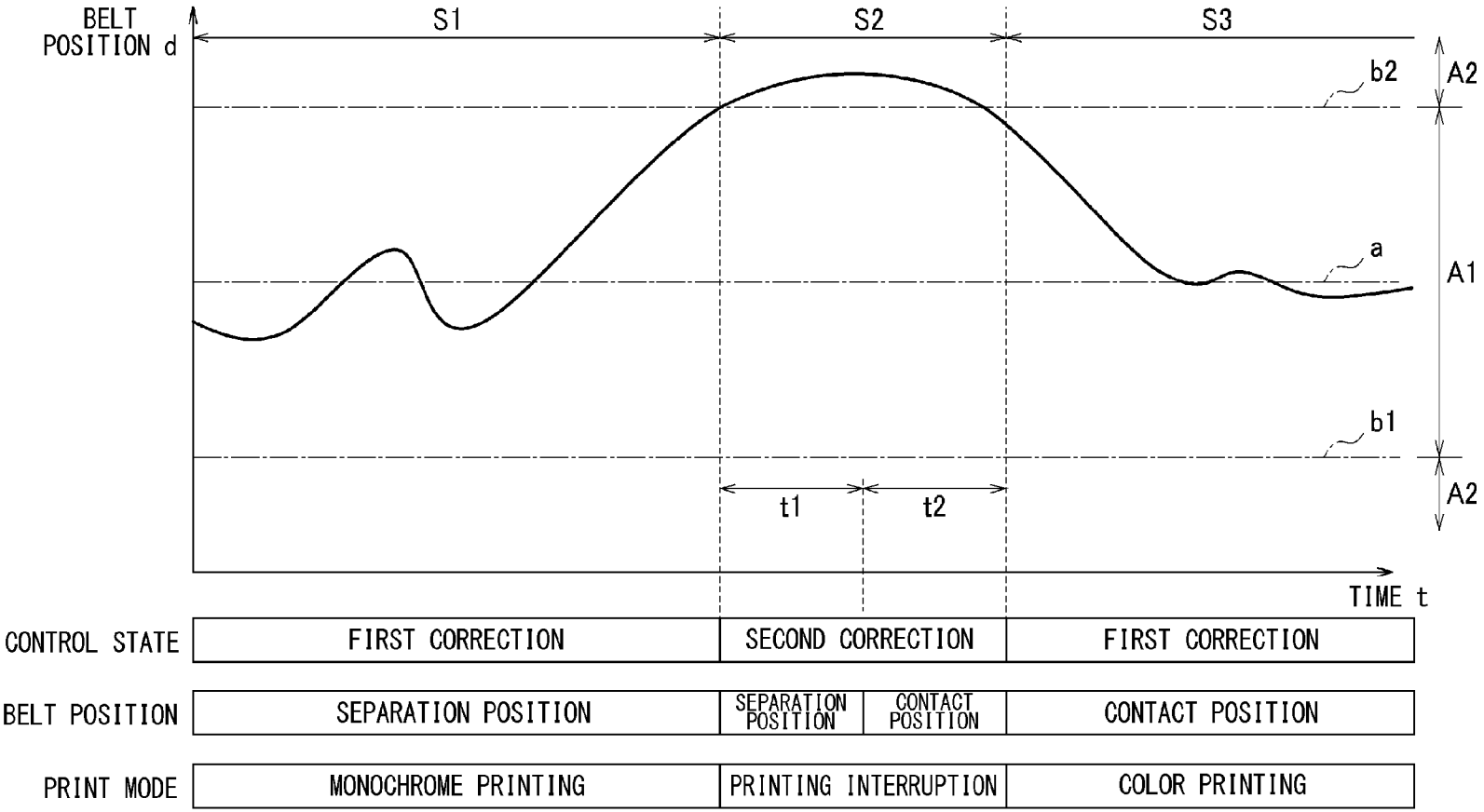
FIG. 15 is a graph showing transition of the belt end surface in the case of executing meandering correction during monochrome printing.

FIG. 14 is a graph showing transition of the belt end surface 7*a* in the case of performing meandering correction upon four-full-color printing. FIG. 15 is a graph showing transition of the belt end surface 7*a* in the case of performing meandering correction upon monochrome printing. The print modes in FIGS. 14 and 15, four-full-color printing is referred to as "color printing".

As shown in FIG. 14, in the case where the print mode is color printing, when the position of the belt end surface 7*a* of the intermediate transfer belt 7 is out of the correction range (detection range A1) and within the allowable range (detection range A2) (interval S2), the control portion (first control portion) 100 executes the second correction described in FIG. 13.

Then, if the position of the belt end surface 7*a* of the intermediate transfer belt 7 does not return into the correction range (detection range A1) even after the second correction is performed for the time t1 in the interval S2 as shown in FIG. 14, the control portion (second control portion) 100 changes the position of the intermediate transfer belt 7 from the contact position to the separation position after the elapse of the time t1. Thereafter, the control portion (second control portion) 100 further performs the second correction for the time t2 in the state in which the intermediate transfer belt 7 is positioned at the separation position.

Thereafter, as shown in FIG. 14, in the state in which the position of the intermediate transfer belt 7 has been changed to the separation position, if the position of the belt end surface 7*a* of the intermediate transfer belt 7 has returned into the correction range (detection range A1) by the second correction being performed for the time t2, the control portion (second control portion) 100 fixes the position of the intermediate transfer belt 7 at the separation position. At the same time, at the time when the meandering correction has shifted to the first correction (interval S3), the control portion (second control portion) 100 sets the print mode to monochrome printing, to restart printing. In this case, in the printer 1, four-full-color printing cannot be executed but monochrome printing can be executed.

On the other hand, as shown in FIG. 15, in the case where the print mode is monochrome printing, when the position of the belt end surface 7*a* of the intermediate transfer belt 7 is out of the correction range (detection range A1) and within the allowable range (detection range A2) (interval S2), the control portion (first control portion) 100 executes the second correction described in FIG. 13.

Then, if the position of the belt end surface 7*a* of the intermediate transfer belt 7 does not return into the correction range (detection range A1) even after the second correction is performed for the time t1 in the interval S2 as shown in FIG. 15, the control portion (second control portion) 100 changes the position of the intermediate transfer belt 7 from the separation position to the contact position after the elapse of the time t1. Thereafter, the control portion (second control portion) 100 further performs the second correction for the time t2 in the state in which the intermediate transfer belt 7 is positioned at the contact position.

Thereafter, as shown in FIG. 15, in the state in which the position of the intermediate transfer belt 7 has been changed to the contact position, if the position of the belt end surface 7*a* of the intermediate transfer belt 7 has returned into the correction range (detection range A1) by the second correction being performed for the time t2, the control portion (second control portion) 100 fixes the position of the intermediate transfer belt 7 at the contact position. At the same time, at the time when the meandering correction has shifted to the first correction (interval S3), the control portion (second control portion) 100 sets the print mode to color printing, to restart printing. In this case, in the printer 1, monochrome printing cannot be executed but four-full-color printing can be executed.

The tendency of the above-described meandering of the intermediate transfer belt 7 varies between the cases where the intermediate transfer belt 7 is positioned at the contact position and the separation position with respect to the photosensitive drums 2*a* to 2*c*. It is considered that this is because, when the intermediate transfer belt 7 is made contact with or separate from the photosensitive drums 2*a* to 2*c*, a conveyance speed difference due to torsion or change in tension of the intermediate transfer belt 7 occurs on the front side or the rear side of the intermediate transfer belt 7.

Therefore, in the case where the intermediate transfer belt 7 does not return into the correction range even after the second correction is performed for a predetermined time (time t1), if the positional relationship (contact/separation) between the photosensitive drums 2*a* to 2*c* and the intermediate transfer belt 7 is changed, the tendency of meandering of the intermediate transfer belt 7 can be changed. Therefore, in the second correction, in the case where the intermediate transfer belt 7 does not return into the correction range, if the positional relationship between the photosensitive drums 2*a* to 2*c* and the intermediate transfer belt 7 is changed, the possibility that the intermediate transfer belt 7 will return into the correction range increases.

Then, in the case where the intermediate transfer belt 7 has returned into correction range after the positional relationship between the photosensitive drums 2*a* to 2*c* and the intermediate transfer belt 7 has been changed, if the positional relationship between the photosensitive drums 2*a* to 2*c* and the intermediate transfer belt 7 at this time is fixed, the printer 1 can be driven in either print mode of color printing or monochrome printing.

The printer 1 according to the above embodiment provides the following effects, for example.

In the printer 1 according to the present embodiment, in the case where the intermediate transfer belt 7 does not return into the correction range even though the roller position adjustment mechanism 22 is controlled by the function of the first control portion so as to correct meandering of the intermediate transfer belt 7, the control portion (second control portion) 100 controls the movement mechanism portion 90 so as to change the positions of the primary transfer rollers 13*a* to 13*c* (a plurality of second opposing portions).

Thus, in the second correction, if the intermediate transfer belt 7 does not return into the correction range, the positions of the primary transfer rollers 13*a* to 13*c* are changed, whereby the possibility that the intermediate transfer belt 7 will return into the correction range increases. Then, if the intermediate transfer belt 7 has returned into the correction range after the positions of the primary transfer rollers 13*a* to 13*c* have been changed, the printer 1 can be driven in either print mode of color printing or monochrome printing in accordance with the positions of the primary transfer rollers 13*a* to 13*c* at this time. Therefore, when abnormal meandering of the intermediate transfer belt 7 has occurred, the printer 1 according to the present embodiment can prevent, as much as possible, occurrence of the state in which neither color printing nor monochrome printing can be performed.

In addition, if the intermediate transfer belt 7 has returned into the correction range after the movement mechanism portion 90 has been controlled so as to change the positions of the primary transfer rollers 13*a* to 13*c*, the control portion (second control portion) 100 retains the changed positions of the primary transfer rollers 13*a* to 13*c*.

Thus, if the intermediate transfer belt 7 has returned into the correction range after the positions of the primary transfer rollers 13*a* to 13*c* have been changed, the positions of the primary transfer rollers 13*a* to 13*c* at this time are retained, whereby the printer 1 can be continuously driven by either print mode of color printing or monochrome printing.

In addition, in the case where the intermediate transfer belt 7 does not return into the correction range even though the roller position adjustment mechanism 22 has been controlled by the function of the first control portion so as to correct meandering of the intermediate transfer belt 7, if the positions of the primary transfer rollers 13*a* to 13*c* are the contact positions, the control portion (second control portion) 100 controls the movement mechanism portion 90 so that the positions of the primary transfer rollers 13*a* to 13*c* will become the separation positions.

Thus, in the case where the positions of the primary transfer rollers 13*a* to 13*c* are the contact positions (four-full-color printing), if the intermediate transfer belt 7 does not return into the correction range, the positions of the primary transfer rollers 13*a* to 13*c* become the separation positions (monochrome printing). Therefore, the printer 1 can execute monochrome printing.

In addition, in the case where the intermediate transfer belt 7 does not return into the correction range even though the roller position adjustment mechanism 22 has been controlled by the function of the first control portion so as to correct meandering of the intermediate transfer belt 7, if the positions of the primary transfer rollers 13*a* to 13*c* are the separation positions, the control portion (second control portion) 100 controls the movement mechanism portion 90 so that the positions of the primary transfer rollers 13*a* to 13*c* will become the contact positions.

Thus, in the case where the positions of the primary transfer rollers 13*a* to 13*c* are the separation positions (monochrome printing), if the intermediate transfer belt 7 does not return into the correction range, the positions of the primary transfer rollers 13*a* to 13*c* become the contact positions (four-full-color printing). Therefore, the printer 1 can execute four-full-color printing. In addition, in this case, the printer 1 can also execute monochrome printing as well as four-full-color printing.

In addition, the control portion (first control portion) 100 determines an inclination direction and an inclination angle of the rotary shaft of the driven roller 16 in accordance with the position of the intermediate transfer belt 7 detected by the belt sensor 21, and controls the roller position adjustment mechanism 22 so that the rotary shaft of the driven roller 16 will be directed in the inclination direction at the inclination angle.

Therefore, in accordance with the position of the meandering intermediate transfer belt 7, the intermediate transfer belt 7 can be swiftly returned into the correction range.

Although preferred embodiments of the present disclosure have been thus described, the present disclosure is not limited to the above embodiments but may be carried out in various modes.

The movement mechanism portion 90 of the present embodiment includes the eccentric cam 92 and the third drive motor 93 as a mechanism for moving the frame 91 supporting the primary transfer rollers 13*a* to 13*c* to the contact position or the separation position with respect to the photosensitive drums 2*a* to 2*c*. Instead, the movement mechanism portion 90 may be formed by a drive motor and a gear mechanism. In this case, the gear mechanism is rotated by a rotational force of the drive motor, whereby the frame 91 supported by the rotary shaft 23*a* of the support roller 23 can be moved to the contact position or the separation position.

The movement mechanism portion 90 may be formed by a rod and an actuator linked with the frame 91. In this case, the rod is driven by motive power generated by the actuator, whereby the frame 91 supported by the rotary shaft 23*a* of the support roller 23 can be moved to the contact position or the separation position.

The control portion (first control portion) 100 of the present embodiment determines an inclination direction and an inclination angle of the rotary shaft of the driven roller 16 by referring to a data table (ROM) on which light amount detection signals (voltage values) outputted from the belt sensor 21 are respectively associated with inclination directions and inclination angles of the rotary shaft of the driven roller 16 that are required for returning the intermediate transfer belt 7 to a predetermined target position. Instead, an inclination direction and an inclination angle of the rotary shaft of the driven roller 16 may be calculated by a calculation expression using a light amount detection signal (voltage value) as a parameter.

In the present embodiment, an example where the image forming apparatus according to the present disclosure is applied to a printer capable of four-full-color printing and monochrome printing, has been described. Instead, the present disclosure can be applied to general image forming apparatuses configured such that an endless belt can be moved to a contact position and a separation position with respect to a photosensitive drum. For example, the present disclosure can be applied to a copy machine, a facsimile machine, or the like having such a configuration.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a first image carrier which allows a toner image to be formed thereon;

a plurality of second image carriers each of which allows a toner image to be formed thereon;

a transfer belt of endless belt type, which allows the toner images formed on the first image carrier and/or the second image carriers to be transferred onto the transfer belt;

a drive roller which supports the transfer belt in a rotatable manner and is capable of rotating the transfer belt;

a driven roller which supports the transfer belt in a rotatable manner;

a first opposing portion which is provided opposing to the first image carrier via the transfer belt and causes the transfer belt to contact the first image carrier;

a plurality of second opposing portions which are provided opposing to the plurality of second image carriers via the transfer belt and are each capable of being positioned at either contact positions that cause the transfer belt to contact the plurality of second image carriers or separation positions that cause the transfer belt to be separated from the plurality of second image carriers;

a movement mechanism portion which moves the positions of the plurality of second opposing portions to the contact positions or the separation positions;

position information acquiring portion which acquires position information with respect to a width direction about the transfer belt;

a roller position adjustment mechanism which adjusts the orientation of a rotary shaft of the driven roller;

a first control portion which determines correction information for returning the transfer belt to a predetermined target position, based on the position information about the transfer belt acquired by the position information acquiring portion, and controls the roller position adjustment mechanism based on the correction information; and a second control portion which, in the case where, during the control for the roller position adjustment mechanism based on the correction information by the first control portion, the transfer belt does not return into a correction range centered on the target position within a predetermined time and is out of the correction range, controls the movement mechanism portion so as to change the positions of the plurality of second opposing portions.

2. The image forming apparatus according to claim 1, wherein if the transfer belt has returned into the correction range by the control for the movement mechanism portion so as to change the positions of the plurality of second opposing portions, the second control portion controls the movement mechanism portion so as to retain the changed positions of the plurality of second opposing portions.

3. The image forming apparatus according to claim 2, wherein in a state in which the plurality of second opposing portions are positioned at the contact positions, in the case where, during the control for the roller position adjustment mechanism based on the correction information by the first control portion, the transfer belt does not return into the correction range within the predetermined time and is out of the correction range, the second control portion controls the movement mechanism portion so as to move the plurality of second opposing portions to the separation positions.

4. The image forming apparatus according to claim 3, wherein the roller position adjustment mechanism is capable of adjusting the inclination direction and the inclination angle of the rotary shaft of the driven roller, and the first control portion determines an inclination direction and an inclination angle of the rotary shaft of the driven roller, based on the position information about the transfer belt acquired by the position information acquiring portion, and controls the roller position adjustment mechanism so that the rotary shaft of the driven roller will be directed in the inclination direction at the inclination angle.

5. The image forming apparatus according to claim 2, wherein in a state in which the plurality of second opposing portions are positioned at the separation positions, in the case where, during the control for the roller position adjustment mechanism based on the correction information by the first control portion, the transfer belt does not return into the correction range within the predetermined time and is out of the correction range, the second control portion controls the movement mechanism portion so as to move the plurality of second opposing portions to the contact positions.

6. The image forming apparatus according to claim 5, wherein the roller position adjustment mechanism is capable of adjusting the inclination direction and the inclination angle of the rotary shaft of the driven roller, and the first control portion determines an inclination direction and an inclination angle of the rotary shaft of the driven roller, based on the position information about the transfer belt acquired by the position information acquiring portion, and controls the roller position adjustment mechanism so that the rotary shaft of the driven roller will be directed in the inclination direction at the inclination angle.

7. The image forming apparatus according to claim 1, wherein in a state in which the plurality of second opposing portions are positioned at the contact positions, in the case where, during the control for the roller position adjustment mechanism based on the correction information by the first control portion, the transfer belt does not return into the correction range within the predetermined time and is out of the correction range, the second control portion controls the movement mechanism portion so as to move the plurality of second opposing portions to the separation positions.

8. The image forming apparatus according to claim 7, wherein the roller position adjustment mechanism is capable of adjusting the inclination direction and the inclination angle of the rotary shaft of the driven roller, and the first control portion determines an inclination direction and an inclination angle of the rotary shaft of the driven roller, based on the position information about the transfer belt acquired by the position information acquiring portion, and controls the roller position adjustment mechanism so that the rotary shaft of the driven roller will be directed in the inclination direction at the inclination angle.

9. The image forming apparatus according to claim 1, wherein in a state in which the plurality of second opposing portions are positioned at the separation positions, in the case where, during the control for the roller position adjustment mechanism based on the correction information by the first control portion, the transfer belt does not return into the correction range within the predetermined time and is out of the correction range, the second control portion controls the movement mechanism portion so as to move the plurality of second opposing portions to the contact positions.

10. The image forming apparatus according to claim 9, wherein the roller position adjustment mechanism is capable of adjusting the inclination direction and the inclination angle of the rotary shaft of the driven roller, and the first control portion determines an inclination direction and an inclination angle of the rotary shaft of the driven roller, based on the position information about the transfer belt acquired by the position information acquiring portion, and controls the roller position adjustment mechanism so that the rotary shaft of the driven roller will be directed in the inclination direction at the inclination angle.

11. The image forming apparatus according to claim 1, wherein the roller position adjustment mechanism is capable of adjusting the inclination direction and the inclination angle of the rotary shaft of the driven roller, and the first control portion determines an inclination direction and an inclination angle of the rotary shaft of the driven roller, based on the position information about the transfer belt acquired by the position information acquiring portion, and controls the roller position adjustment mechanism so that the rotary shaft of the driven roller will be directed in the inclination direction at the inclination angle.

* * * * *